US010380928B2

(12) United States Patent
Yang

(10) Patent No.: US 10,380,928 B2
(45) Date of Patent: Aug. 13, 2019

(54) DISPLAY DEVICE AND DRIVING MODULE THEREOF

(71) Applicant: NOVATEK Microelectronics Corp., Hsin-Chu (TW)

(72) Inventor: Kai-Min Yang, Kaohsiung (TW)

(73) Assignee: NOVATEK Microelectronics Corp., Hsin-Chu (TW)

( * ) Notice: Subject to any disclaimer, the term of this patent is extended or adjusted under 35 U.S.C. 154(b) by 0 days.

(21) Appl. No.: 15/721,972

(22) Filed: Oct. 2, 2017

(65) Prior Publication Data

US 2018/0025680 A1 Jan. 25, 2018

Related U.S. Application Data

(63) Continuation of application No. 14/641,430, filed on Mar. 8, 2015, now Pat. No. 9,812,049.

(30) Foreign Application Priority Data

Jun. 4, 2014 (TW) ..... 103119430 A

(51) Int. Cl.
*G09G 3/18* (2006.01)
*G09G 3/20* (2006.01)

(52) U.S. Cl.
CPC ..... *G09G 3/18* (2013.01); *G09G 3/20* (2013.01)

(58) Field of Classification Search
CPC ... G09G 2300/0439; G09G 2300/0443; G09G 2300/0447; G09G 2300/0452; G09G 2300/0456; G09G 2300/046; G09G 2300/0465; G09G 2300/0469; G09G 2300/0473; G09G 2300/0478; G09G 2300/0482; G09G 2300/0486; G09G 2300/0491; G09G 2300/0495; G09G 2300/06; G09G 2300/08; G09G 2300/0804; G09G 2300/0809; G09G 2300/0823; G09G 2300/0828; G09G 3/18; G09G 3/20; G09G 2354/00; A61M 21/02; A61M 21/00; A61M 2021/0044; A61M 2021/0083; A61M 2205/3306; A61M 2330/00; A61B 5/4809
See application file for complete search history.

(56) References Cited

U.S. PATENT DOCUMENTS

2005/0040756 A1 2/2005 Winters
2005/0270444 A1 12/2005 Miller
(Continued)

FOREIGN PATENT DOCUMENTS

CN 1722193 A 1/2006
CN 102262854 A 11/2011
(Continued)

*Primary Examiner* — Lunyi Lao
*Assistant Examiner* — Jarurat Suteerawongsa
(74) *Attorney, Agent, or Firm* — Winston Hsu

(57) ABSTRACT

A display device including a plurality sub-pixel groups is disclosed. Each of the plurality sub-pixel groups includes a first sub-pixel, locating at a first column, a first row and a second row adjacent to the first row; a second sub-pixel, locating at a second column adjacent to the first column, the first row and the second row; a third sub-pixel locating at a third column adjacent to the second column and a first row; and a fourth sub-pixel locating at the third column and the second row.

15 Claims, 24 Drawing Sheets

(56) References Cited

U.S. PATENT DOCUMENTS

| | | | | |
|---|---|---|---|---|
| 2009/0115952 | A1* | 5/2009 | Nakamura | G02B 5/201 349/143 |
| 2009/0121983 | A1 | 5/2009 | Sung | |
| 2011/0254879 | A1 | 10/2011 | Mori | |
| 2012/0268357 | A1 | 10/2012 | Shin | |
| 2014/0204008 | A1 | 7/2014 | Chu-Ke | |

FOREIGN PATENT DOCUMENTS

| | | | |
|---|---|---|---|
| CN | 103257494 | A | 8/2013 |
| CN | 103778888 | A | 5/2014 |
| KR | 101005903 | B1 | 1/2011 |
| TW | 201145242 | | 12/2011 |
| WO | 2013172400 | A1 | 11/2013 |

* cited by examiner

DISPLAY DEVICE AND DRIVING MODULE THEREOF

CROSS REFERENCE TO RELATED APPLICATIONS

This is a continuation application of U.S. application Ser. No. 14/641,430, the contents of which are incorporated herein by reference.

BACKGROUND OF THE INVENTION

1. Field of the Invention

The present invention relates to a display device and driving module thereof, and more particularly, to a display device reducing power consumption and increasing brightness via changing pixel arrangement method and driving module thereof.

2. Description of the Prior Art

A liquid crystal display (LCD) is a flat panel display which has the advantages of low radiation, light weight and low power consumption and is widely used in various information technology (IT) products, such as notebook computers, personal digital assistants (PDA), and mobile phones. An active matrix thin film transistor (TFT) LCD is the most commonly used transistor type in LCD families, and particularly in the large-size LCD family. A driving system installed in the LCD includes a timing controller, source drivers and gate drivers. The source and gate drivers respectively control data lines and scan lines, which intersect to form a cell matrix. Each intersection is a cell including crystal display molecules and a TFT. In the driving system, the gate drivers are responsible for transmitting scan signals to gates of the TFTs to turn on the TFTs on the panel. The source drivers are responsible for converting digital image data, sent by the timing controller, into analog voltage signals and outputting the voltage signals to sources of the TFTs. When a TFT receives the voltage signals, a corresponding liquid crystal molecule has a terminal whose voltage changes to equalize the drain voltage of the TFT, which thereby changes its own twist angle. The rate that light penetrates the liquid crystal molecule is changed accordingly, allowing different colors to be displayed on the panel.

An image quality of the LCD can be determined via counting a number of pixels of the LCD located in a direction. For example, the user may acquire a reference of determining the image quality of the LCD via calculating the pixels per inch (PPI). Please refer to FIG. 1, which is a schematic diagram of the relationship between the image quality and the PPI. As shown in FIG. 1, the image quality is proportional to the PPI. However, recognizing ability of the eyes has a limit. When the PPI of the LCD exceeds a threshold, the eyes generally cannot recognize each pixel of the LCD. In other words, the image viewed by the eyes would become no-grid if the PPI of the LCD exceeds the threshold.

For example, under a condition that the visual acuity of the eyes is 1.0 and a distance between the eyes and the LCD is 12 inches, the eyes is difficult to recognize distances between the pixels of the LCD when the PPI of the LCD exceeds 286. In other words, the image received by the eyes becomes no-grid if the PPI of the LCD reaches 286. In such a condition, the number of sub-pixels corresponding to each pixel can be accordingly decreased, to increase the aperture ratio and to reduce the power consumption of the LCD. Thus, how to decrease the number of sub-pixel while maintaining the image quality becomes a topic to be discussed.

SUMMARY OF THE INVENTION

In order to solve the above problem, the present invention provides a reducing power consumption and increasing brightness via changing pixel arrangement method and driving module thereof.

In an embodiment, the present invention discloses a display device, comprising a plurality of sub-pixel groups having the same sub-pixel pattern, wherein the plurality of sub-pixel groups comprise a first sub-pixel group, at least one second sub-pixel group located at the same columns as the first column and at least one third sub-pixel group located at the same rows as the first sub-pixel group. The first sub-pixel group comprises a first sub-pixel, locating at a first column, a first row and a second row adjacent to the first row; a second sub-pixel, locating at a second column adjacent to the first column, the first row and the second row; a third sub-pixel locating across a third column adjacent to the second column and a fourth column adjacent to the third column; and a fourth sub-pixel locating across the third column and the fourth column; wherein the third sub-pixel and the fourth sub-pixel locate at two neighboring rows that comprise at least one of the first row and the second row.

In another embodiment, the present invention discloses a driving module, for a display device comprising a plurality of sub-pixel groups having the same sub-pixel pattern, wherein the plurality of sub-pixel groups comprise a first sub-pixel group, at least one second sub-pixel group located at the same columns as the first column and at least one third sub-pixel group located at the same rows as the first sub-pixel group. The first sub-pixel group comprises a first sub-pixel, locating at a first column, a first row and a second row adjacent to the first row; a second sub-pixel, locating at a second column adjacent to the first column and the first row and the second row; a third sub-pixel locating at a third column adjacent to the second column and a fourth column adjacent to the third column; and a fourth sub-pixel locating across the third column and the fourth column; wherein the third sub-pixel and the fourth sub-pixel locate at two neighboring rows that comprise at least one of the first row and the second row.

These and other objectives of the present invention will no doubt become obvious to those of ordinary skill in the art after reading the following detailed description of the preferred embodiment that is illustrated in the various figures and drawings.

DETAILED DESCRIPTION

The present invention reduces a number of sub-pixels corresponding to each pixel via different arrangements of the sub-pixels. An aperture ratio and brightness of the liquid crystal display (LCD) are accordingly improved, the power consumption and the layout area of the LCD are further decreased.

Figure 1:
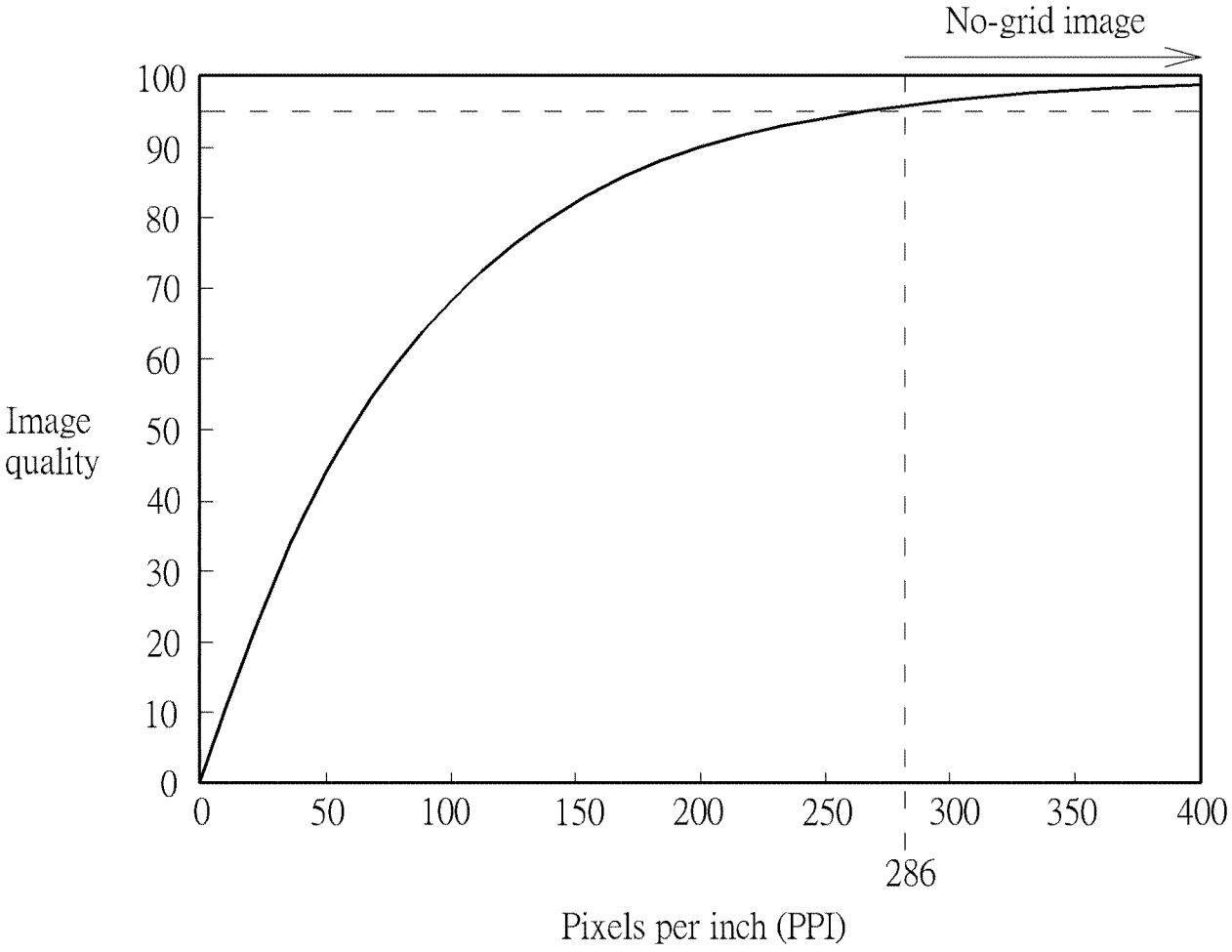
FIG. 1 is a schematic diagram of the relationship between the image quality and the pixel per inch.
Figure 2:
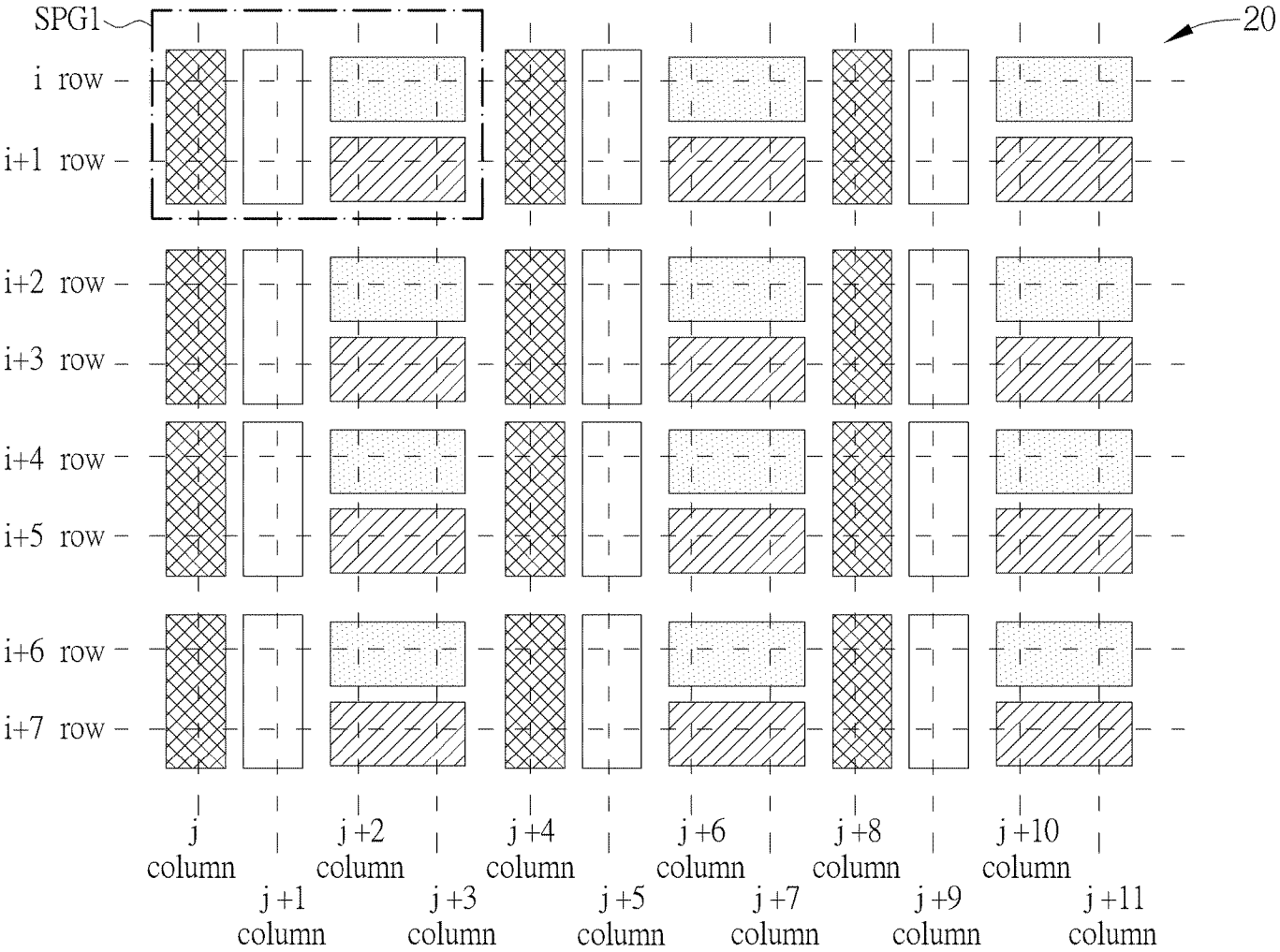
FIG. 2 is a schematic diagram of a display device according to an embodiment of the present invention.
Figure 3:
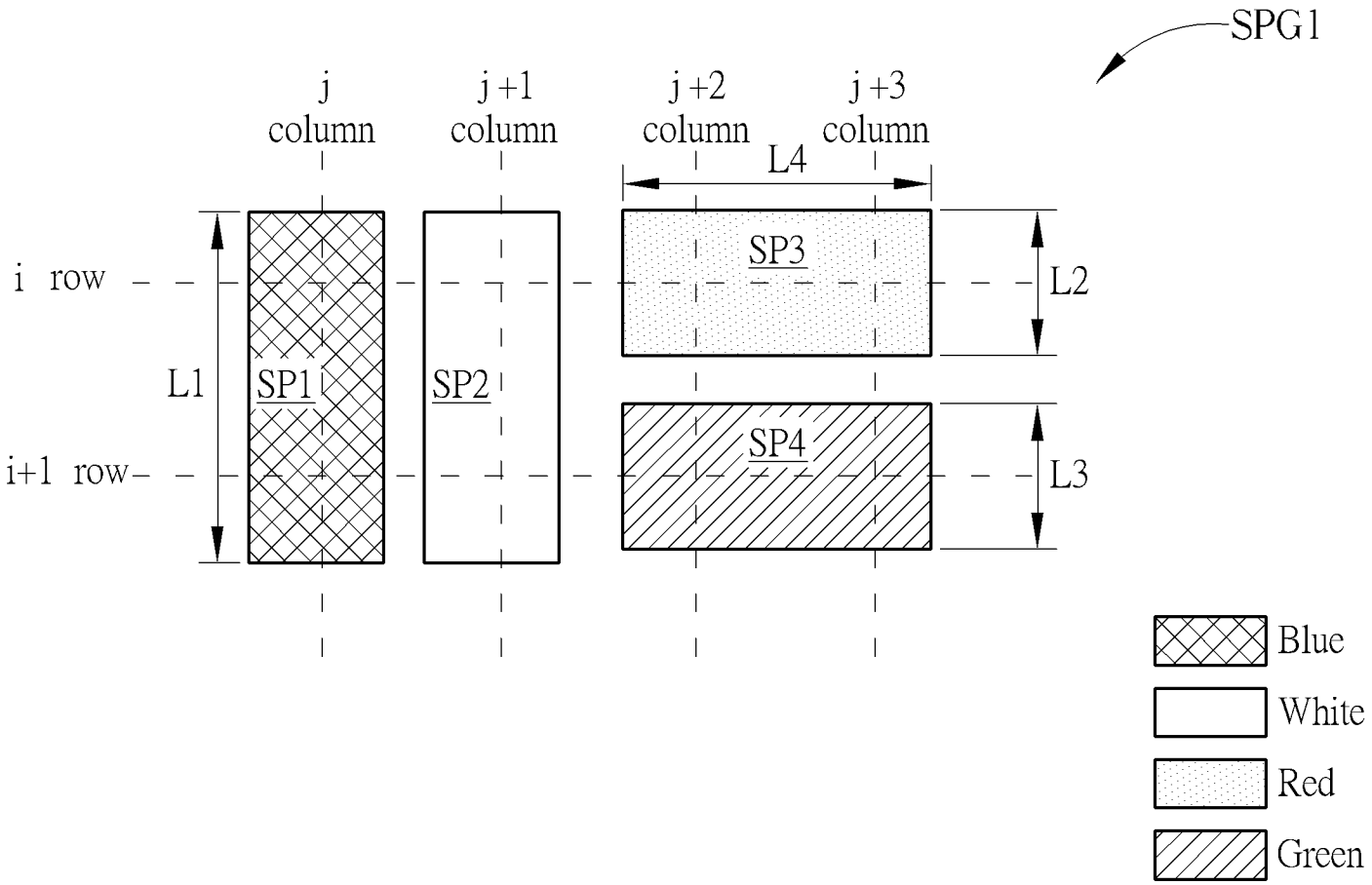
FIG. 3 is a schematic diagram of the sub-pixel group shown in FIG. 2.

Please refer to FIG. 2, which is a schematic diagram of a display device 20 according to an embodiment of the present invention. The display device 20 may be an electronic device with a liquid crystal panel, such as a television, a smart phone or a tablet. FIG. 2 only shows parts of sub-pixels of the display device 20 for illustrations. Note that, FIG. 2 is utilized for illustrating the relative positions of the sub-pixels and not for limiting the ratio between length and width. As shown in FIG. 2, the display device 20 comprises a plurality of repeating sub-pixel groups SPG1 (only one sub-pixel group SPG1 is marked in FIG. 2 for illustrations). In order to simplify the descriptions, please refer to FIG. 3 which is a schematic diagram of the sub-pixel group SPG1 shown in FIG. 2. In FIG. 3, the sub-pixel group SPG1 comprises sub-pixels SP1-SP4. The sub-pixel SP1 is located at the j column, the i row and the i+1 row and the sub-pixel SP2 is located at the j+1 column, the i row and the i+1 row. On the other hand, the sub-pixels SP3 and SP4 are transversely located at the j+2 column and the j+3 column (the j+2 column and the j+3 column may be regarded as a single column) and are respectively located at the i row and the i+1 row. Via the abovementioned arrangement of the sub-pixels SP1-SP4, the sub-pixel group SPG1 is corresponding to 2 pixels. That is, a number of the sub-pixels corresponding to a pixel is reduced, to increase the aperture ratio of display device 20 and to decrease the power consumption of the display device 20.

In detail, the sub-pixels SP1 and SP2 may have a same height L1 and the height L1 is greater than a height L2 of the sub-pixel SP4 and a height L3 of the sub-pixel SP4. Since the sub-pixels SP3 and SP4 can be regarded as transversely located sub-pixels SP1 and SP2, a length L4 of the sub-pixels SP3 and SP4 is also greater than the heights L2 and L3. Further, the sub-pixels SP1-SP4 correspond to blue, white, red and green, respectively. Via adding the sub-pixel SP2 corresponding to white, the brightness of the display device 20 increases and the power consumption of the display device 20 decreases. Moreover, the sub-pixel group SPG1 is corresponding to 2 pixels and each pixel is corresponding to 2 sub-pixels according to the arrangement shown in FIG. 3. In this embodiment, the sub-pixels SP1 and SP2 form a pixel and the sub-pixels SP3 and SP4 form another pixel. If the resolution of the display device 20 is constant, the number of the sub-pixels utilized for realizing the display device 20 would be reduced and the aperture ratio of the display device 20 would be accordingly increased.

In another embodiment, the sub-pixel SP2 may be corresponding to other colors, such as yellow. Further, the sub-pixel SP2 may be corresponding to one of the colors corresponding to the sub-pixels SP1, SP3 and SP4. That is, the sub-pixels SP1-SP4 are corresponding to at least three colors. Note that, the sequence of the colors corresponding to the sub-pixels SP1-SP4 may be modified according to different applications and design concepts and are not limited to the color sequence shown in FIG. 3. For example, the sub-pixels SP1-SP4 may be changed to be corresponding to red, white, green and blue, and are not limited herein.

As to the polarity arrangement of the sub-pixels SP1-SP4 of the sub-pixel group SPG1 please refer to the following descriptions. Since the sub-pixels SP1 and SP2 are corresponding to the same pixel, the polarity of the sub-pixel SP1 is opposite to that of the sub-pixel SP2. For example, the polarity of the sub-pixel SP2 is negative when the polarity of the sub-pixel SP1 is positive; and the polarity of the sub-pixel SP2 is positive when the polarity of the sub-pixel SP1 is negative. Similarly, since the sub-pixels SP3 and SP4 are corresponding to the same pixel, the polarity of the sub-pixel SP3 is opposite to that of the sub-pixel SP4.

Figure 4:
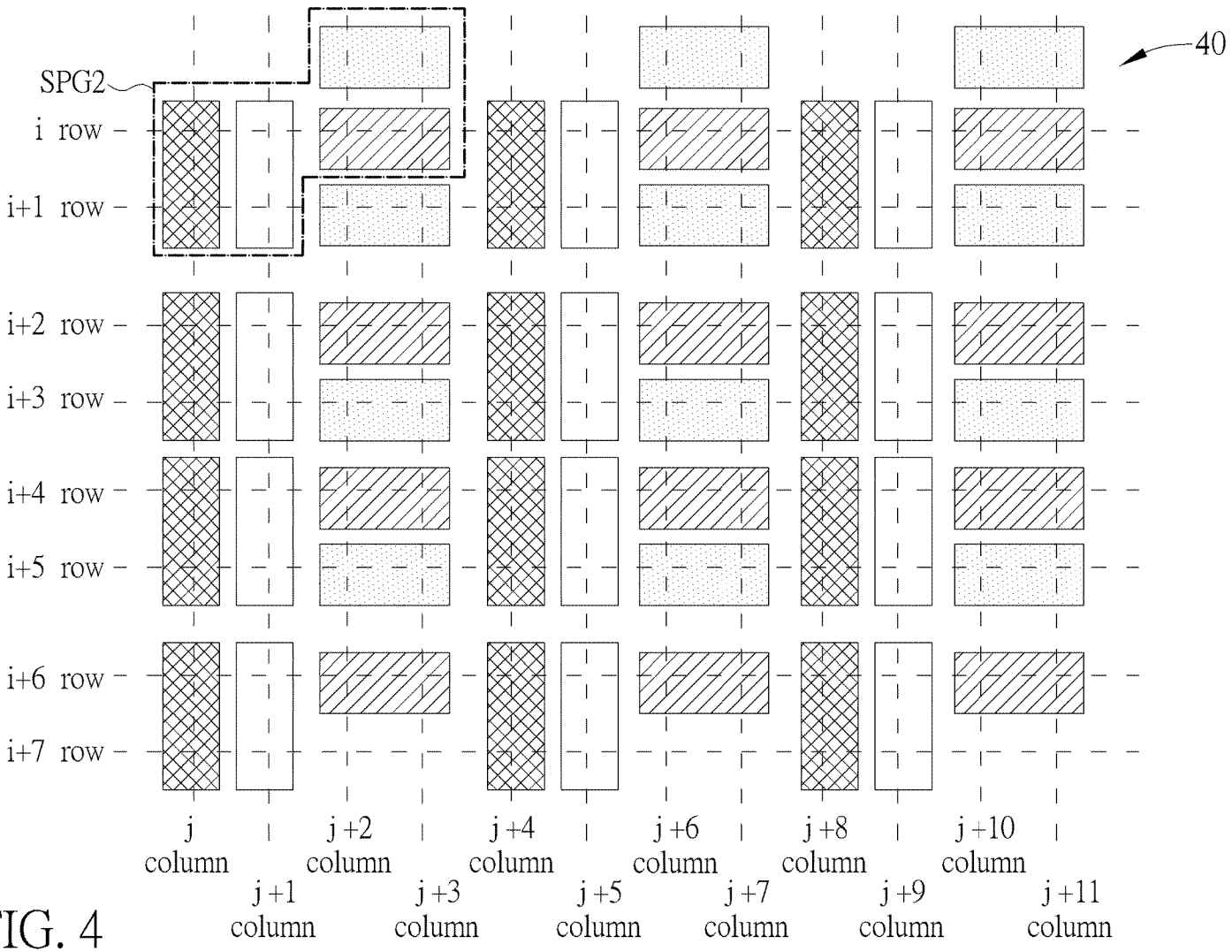
FIG. 4 is a schematic diagram of a display device according to an embodiment of the present invention.
Figure 5:
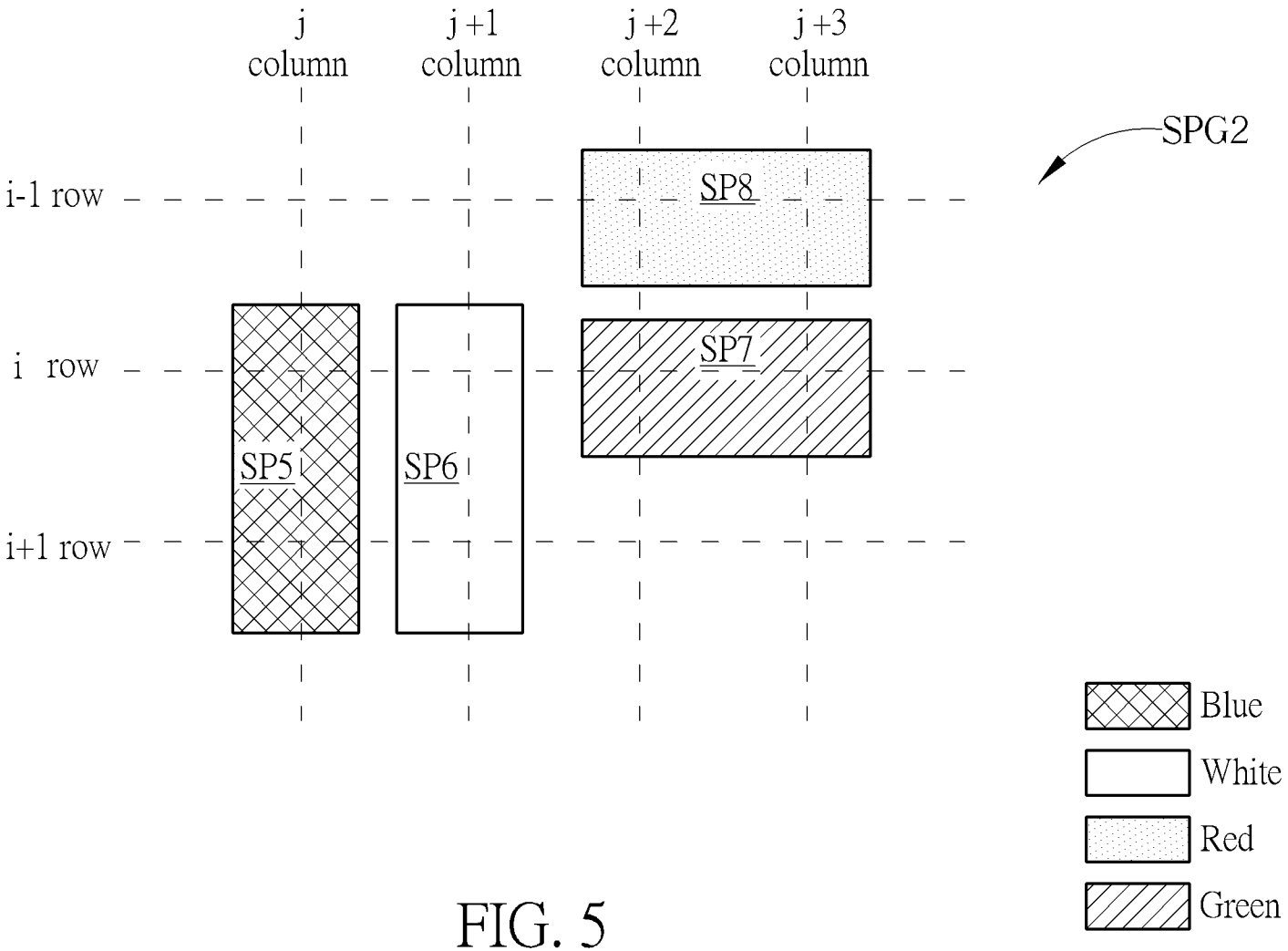
FIG. 5 is a schematic diagram of the sub-pixel group shown in FIG. 4.

In an embodiment, a vertical displacement may exist between the sub-pixels of the display device 20 shown in FIG. 2. Please refer to FIG. 4, which is a schematic diagram of a display device 40 according to an embodiment of the present invention. The display device 40 may be an electronic device with a liquid crystal panel, such as a television, a smart phone or a tablet. FIG. 4 only shows parts of sub-pixels of the display device 40 for illustrations. Note that, FIG. 4 is utilized for illustrating the relative positions of the sub-pixels and not for limiting the ratio between length and width. As shown in FIG. 4, the display device 40 comprises a plurality of repeating sub-pixel groups SPG2 (only one sub-pixel group SPG2 is marked in FIG. 4 for illustrations). In order to simplify the descriptions, please refer to FIG. 5 which is a schematic diagram of the sub-pixel group SPG2 shown in FIG. 4. In FIG. 5, the sub-pixel group SPG2 comprises sub-pixels SP5-SP8. The sub-pixel SP5 is located at the j column, the i row and the i+1 row and the sub-pixel SP6 is located at the j+1 column, the i row and the i+1 row. On the other hand, the sub-pixels SP7 and SP8 are transversely located at the j+2 column and the j+3 column. Different from the sub-pixel group SPG1 shown in FIG. 3, the transverse sub-pixels SP7 and SP8 are shifted upward and are located at the i−1 row and the i row, respectively. Via the abovementioned arrangement of the sub-pixels SP5-SP8, the sub-pixel group SPG2 is corresponding to two pixels and the aperture ratio of the display device 40 is accordingly increased. The colors and the length-width relationships between the sub-pixels SP5-SP8 of the sub-pixel group SPG2 can be referred to the sub-pixels SP1-SP4 of the sub-pixel group SPG1, and are not narrated herein for brevity.

Figure 6:
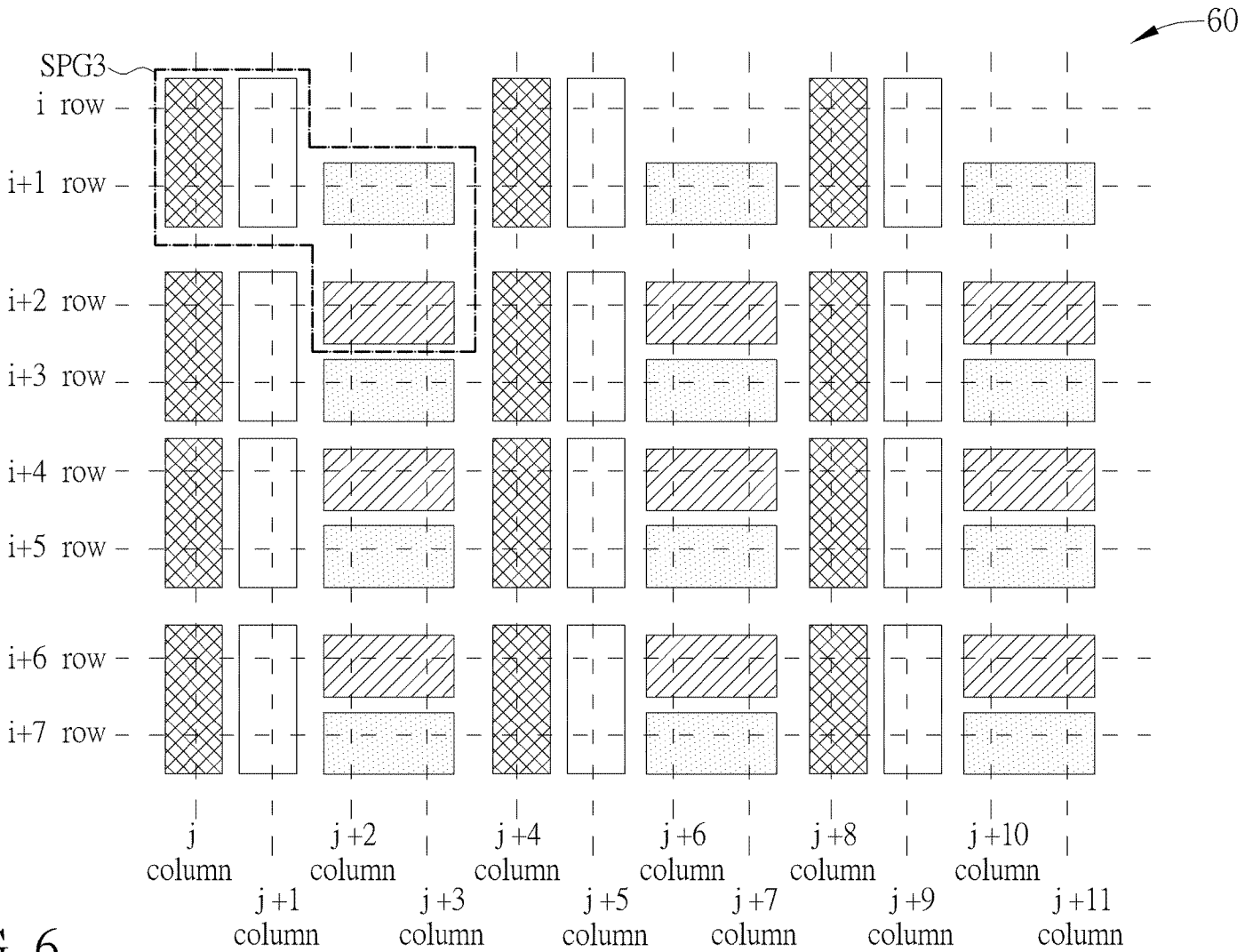
FIG. 6 is a schematic diagram of a display device according to an embodiment of the present invention.
Figure 7:
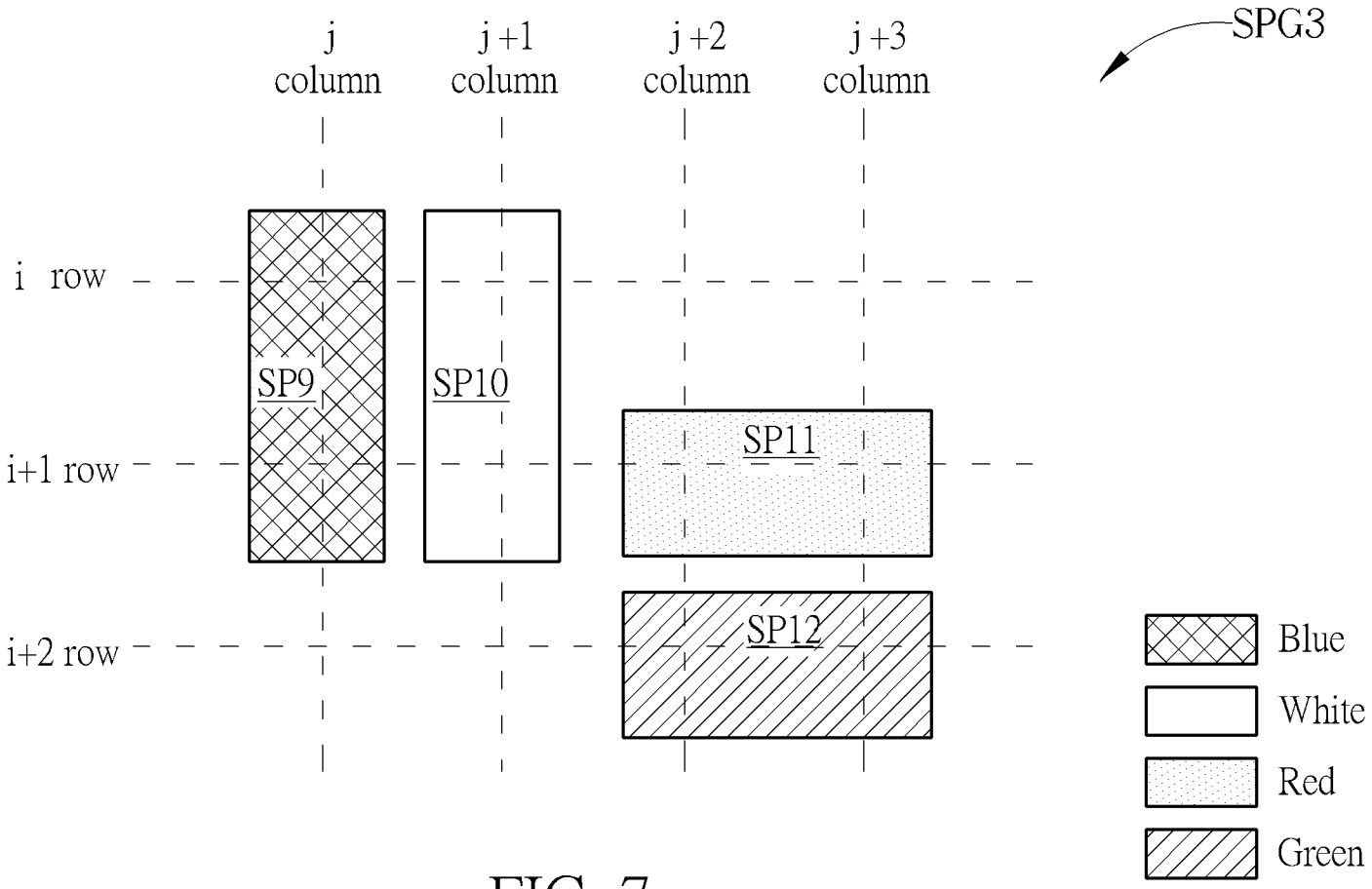
FIG. 7 is a schematic diagram of the sub-pixel group shown in FIG. 6.

Please refer to FIG. 6, which is a schematic diagram of a display device 60 according to an embodiment of the present invention. The display device 60 may be an electronic device with a liquid crystal panel, such as a television, a smart phone or a tablet. FIG. 6 only shows parts of sub-pixels of the display device 60 for illustrations. Note that, FIG. 6 is utilized for illustrating the relative positions of the sub-pixels and not for limiting the ratio between length and width. As shown in FIG. 6, the display device 60 comprises a plurality of repeating sub-pixel groups SPG3 (only one sub-pixel group SPG3 is marked in FIG. 6 for illustrations). In order to simplify the descriptions, please refer to FIG. 7 which is a schematic diagram of the sub-pixel group SPG3 shown in FIG. 6. In FIG. 6, the sub-pixel group SPG3 comprises sub-pixels SP9-SP12. The sub-pixel SP9 is located at the j column, the i row and the i+1 row and the sub-pixel SP10 is located at the j+1 column, the i row and the i+1 row. On the other hand, the sub-pixels SP11 and SP12 are transversely located at the j+2 column and the j+3 column. Different from the sub-pixel group SPG1 shown in FIG. 3, the transverse sub-pixels SP11 and SP12 are shifted downward and are located at the i+1 row and the i+2 row, respectively. Via the abovementioned arrangement of the sub-pixels SP5-SP8, the sub-pixel group SPG3 is corresponding to two pixels and the aperture ratio of the display device 60 is accordingly increased. The colors and the length-width relationships between the sub-pixels SP9-SP12 of the sub-pixel group SPG3 can be referred to the sub-pixels SP1-SP4 of the sub-pixel group SPG1, and are not narrated herein for brevity.

In brief, the upright sub-pixels of the sub-pixel group (e.g. the sub-pixels SP1 and SP2, SP5 and SP6 or SP9 and SP10) are located at the rows overlapping at least one of the transverse sub-pixels of the sub-pixel group (e.g. the sub-pixels SP3 and SP4, SP7 and SP8 or SP11 and SP12).

Figure 8:
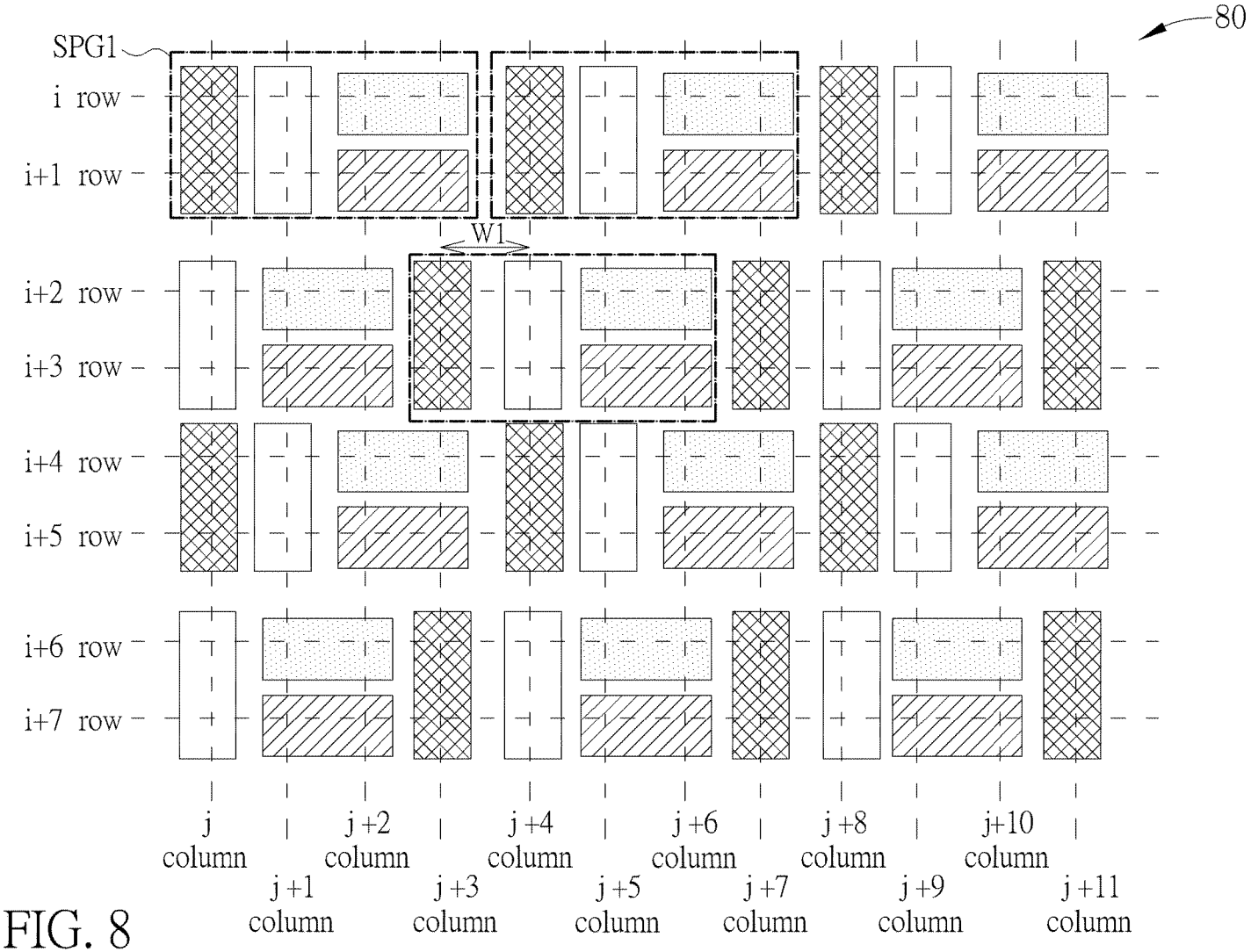
FIG. 8 is a schematic diagram of a display device according to an embodiment of the present invention.

In an embodiment, a horizontal displacement may exist between the sub-pixel groups SPG1 located at adjacent rows in the display device 20 shown in FIG. 2. Please refer to FIG. 8, which is a schematic diagram of a display device 80 according to an embodiment of the present invention. The display device 80 is similar to the display device 20 shown in FIG. 2, thus the components and the signals with the same functions use the same symbols. Different from the display device 20, a horizontal displacement W1 exists between the sub-pixel groups SPG1 located at the adjacent rows (e.g. the sub-pixel groups SPG1 located at the i row and the i+1 row and those located at the i+2 row and the i+3 row). In this embodiment, the horizontal displacement W1 is one-fourth of the width of the sub-pixel group SPG1. As a result, the display device 80 equipping different sub-pixel arrangement can be realized by the sub-pixel group SPG1.

Figure 9:
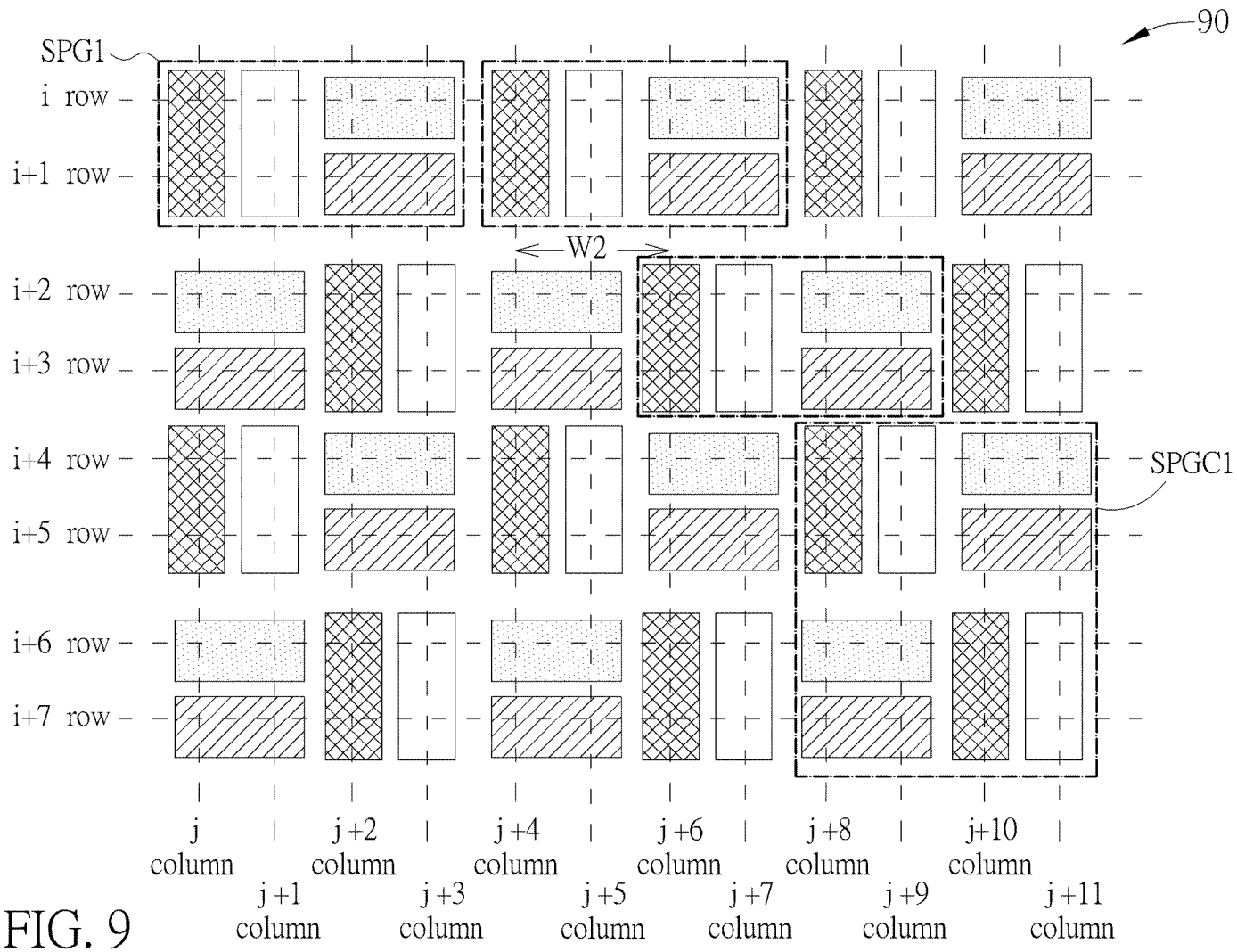
FIG. 9 is a schematic diagram of a display device according to an embodiment of the present invention.

Please refer to FIG. 9, which is schematic diagram of a display device 90 according to an embodiment of the present invention. The display device 90 is similar to the display device 20 shown in FIG. 2, thus the components and the signals with the same functions use the same symbols. Different from the display device 20, a horizontal displacement W2 exists between the sub-pixel groups SPG1 located at the adjacent rows (e.g. the sub-pixel groups SPG1 located at the i row and the i+1 row and those located at the i+2 row and the i+3 row). In this embodiment, the horizontal displacement W2 is half of the width of the sub-pixel group SPG1. Note that, a sub-pixel group SPGC1 shown in FIG. 9 can be regarded as the repeated sub-pixel group in this embodiment. As a result, the display device 90 equipping different sub-pixel arrangement can be realized by the sub-pixel group SPG1.

Figure 10:
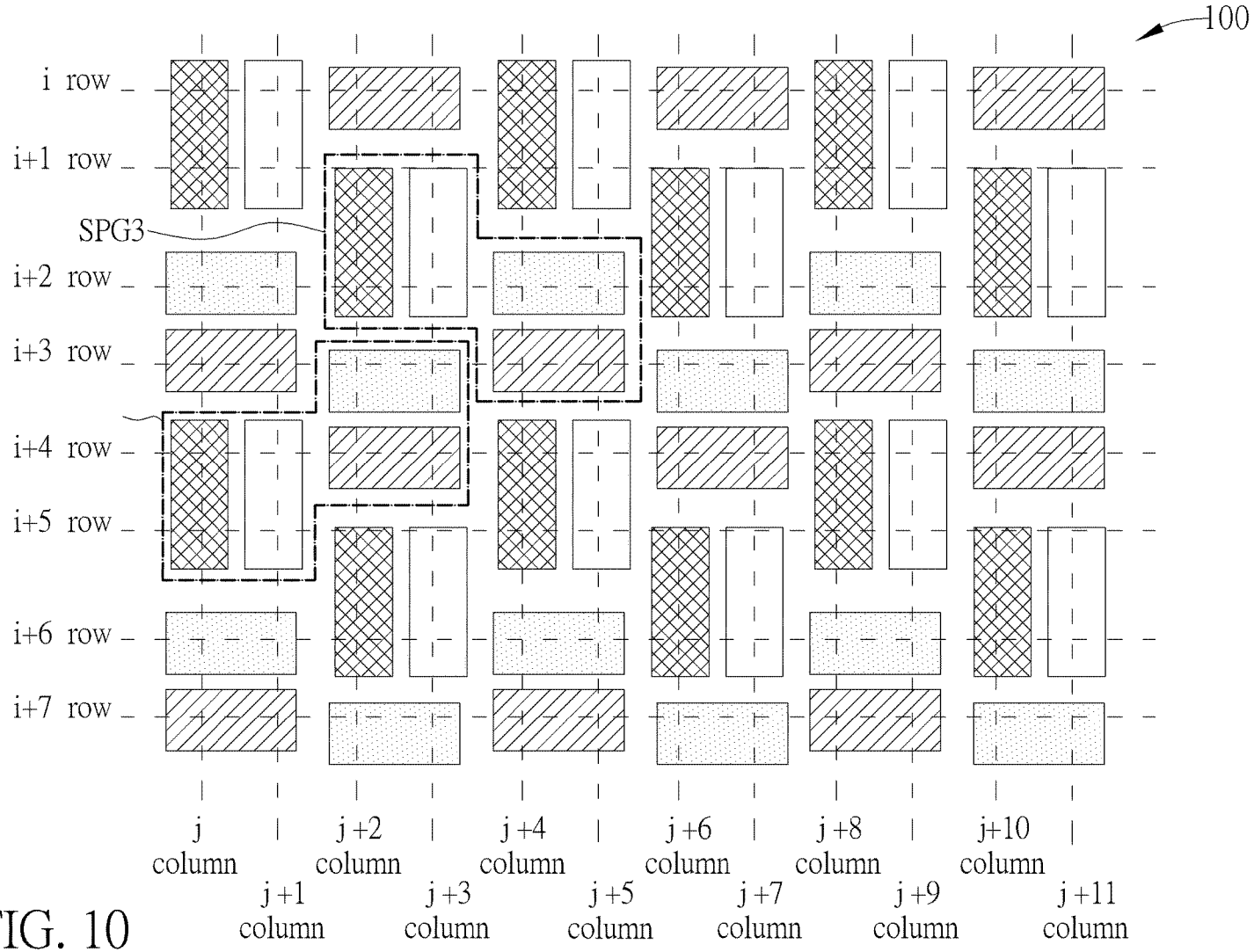
FIG. 10 is a schematic diagram of a display device according to an embodiment of the present invention.

In an embodiment, a horizontal displacement may exist between the sub-pixel groups SPG1 located at the adjacent rows and a vertical displacement may exist between sub-pixels in the display device 20 shown in FIG. 2. Please refer to FIG. 10, which is a schematic diagram of a display device 100 according to an embodiment of the present invention. The display device 100 may be an electronic device with a liquid crystal panel, such as a television, a smart phone or a tablet. As shown in FIG. 10, the sub-pixel groups located at the adjacent rows are the sub-pixel group SPG2 and the sub-pixel group SPG3 shown in FIG. 7, respectively. As a result, the display device 100 equips the sub-pixel arrangement different from that of the display device 20.

Figure 11:
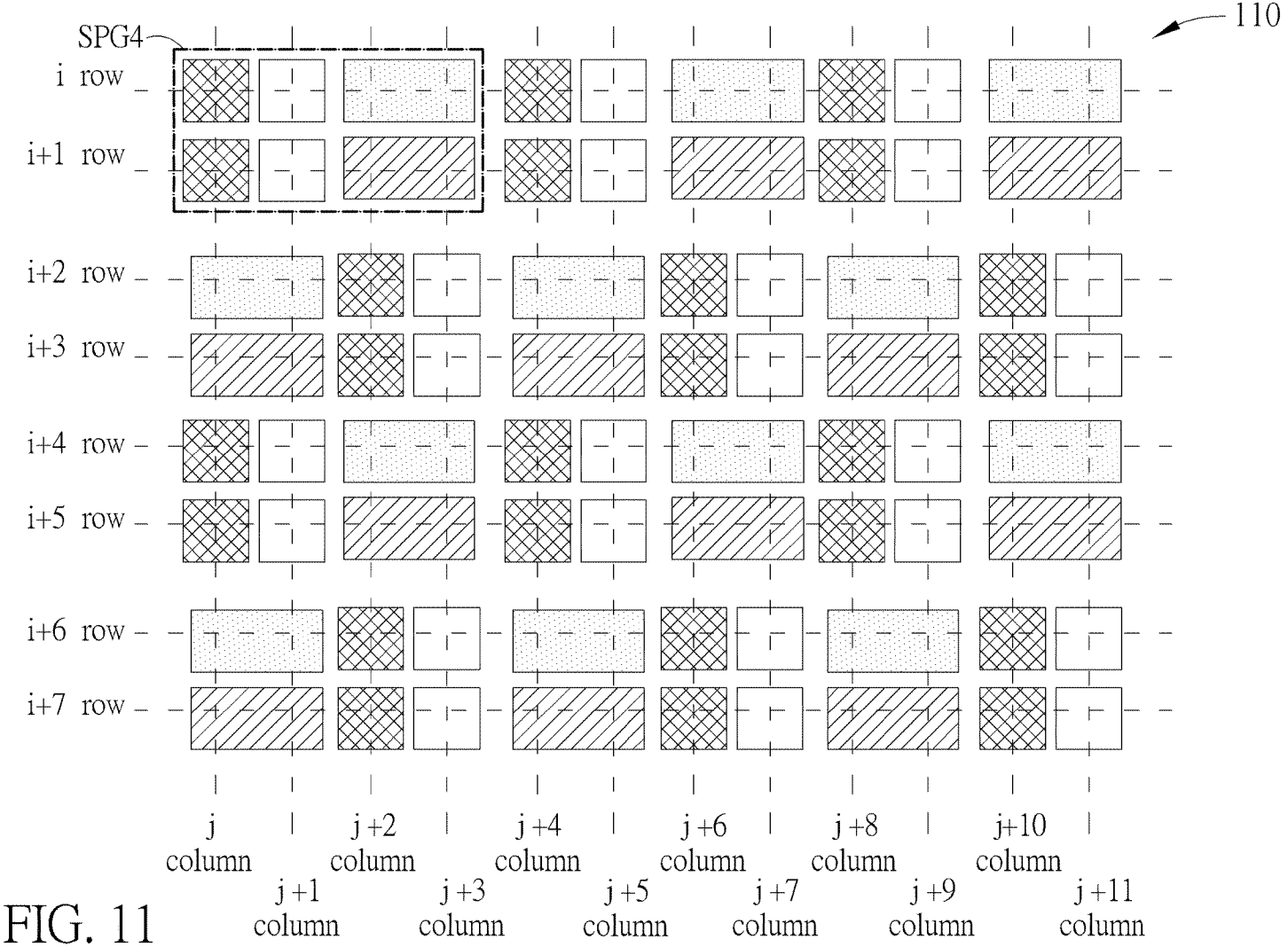
FIG. 11 is a schematic diagram of a display device according to an embodiment of the present invention.
Figure 12:
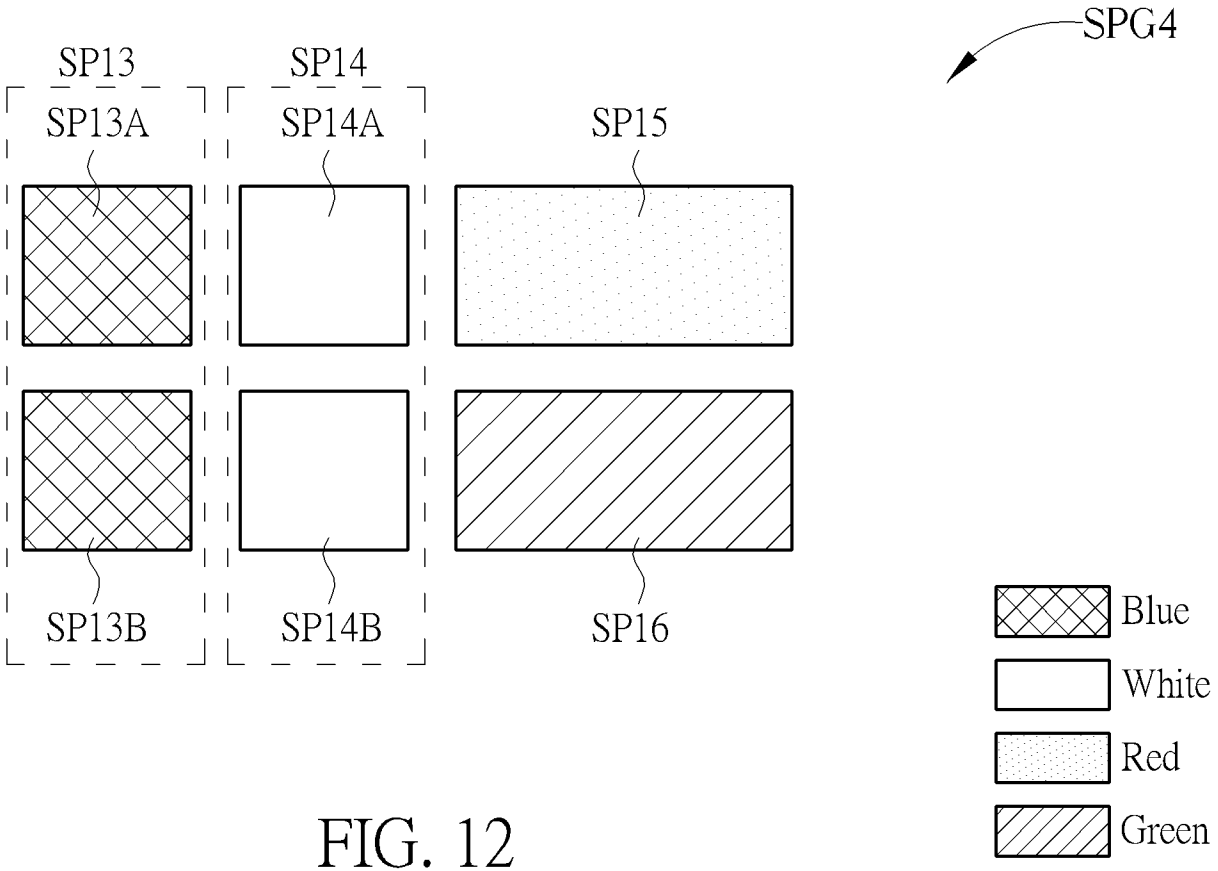
FIG. 12 is a schematic diagram of the sub-pixel group shown in FIG. 11.

In order to simplify the complexity of the circuit layout in the display device, the sub-pixels of the repeating sub-pixel groups may be divided into multiple secondary sub-pixels. Please refer to FIG. 11, which is a schematic diagram of a display device 110 according to an embodiment of the present invention. The display device 110 may be an electronic device with a liquid crystal panel, such as a television, a smart phone or a tablet. FIG. 11 only shows parts of sub-pixels of the display device 110 for illustrations. Note that, FIG. 11 is utilized for illustrating the relative positions of the sub-pixels and not for limiting the ratio between length and width. As shown in FIG. 11, the display device 110 comprises a plurality of repeating sub-pixel groups SPG4 (only one sub-pixel group SPG4 is marked in FIG. 11 for illustrations). In order to simplify the descriptions, please refer to FIG. 12 which is a schematic diagram of the sub-pixel group SPG4 shown in FIG. 11. In FIG. 12, the sub-pixel group SPG4 comprises sub-pixels SP13-SP16 and the arrangement of the sub-pixels SP13-SP16 is similar to that of the sub-pixels SP1-SP4 shown in FIG. 3. In comparison with the sub-pixel group SPG1 shown in FIG. 3, the sub-pixel SP13 of the sub-pixel group SPG4 is divided into secondary sub-pixels SP13A and SP13B; and the sub-pixel SP14 is divided into secondary sub-pixels SP14A and SP14B. In this embodiment, the colors of the secondary sub-pixels SP13A and SP13B equal that of the sub-pixel SP13 and the colors of the secondary sub-pixels SP14A and SP14B also equal that of the sub-pixel SP14. Via dividing the sub-pixels SP13 and SP14, the aperture ratio of the display device 110 is further improved.

Figure 13:
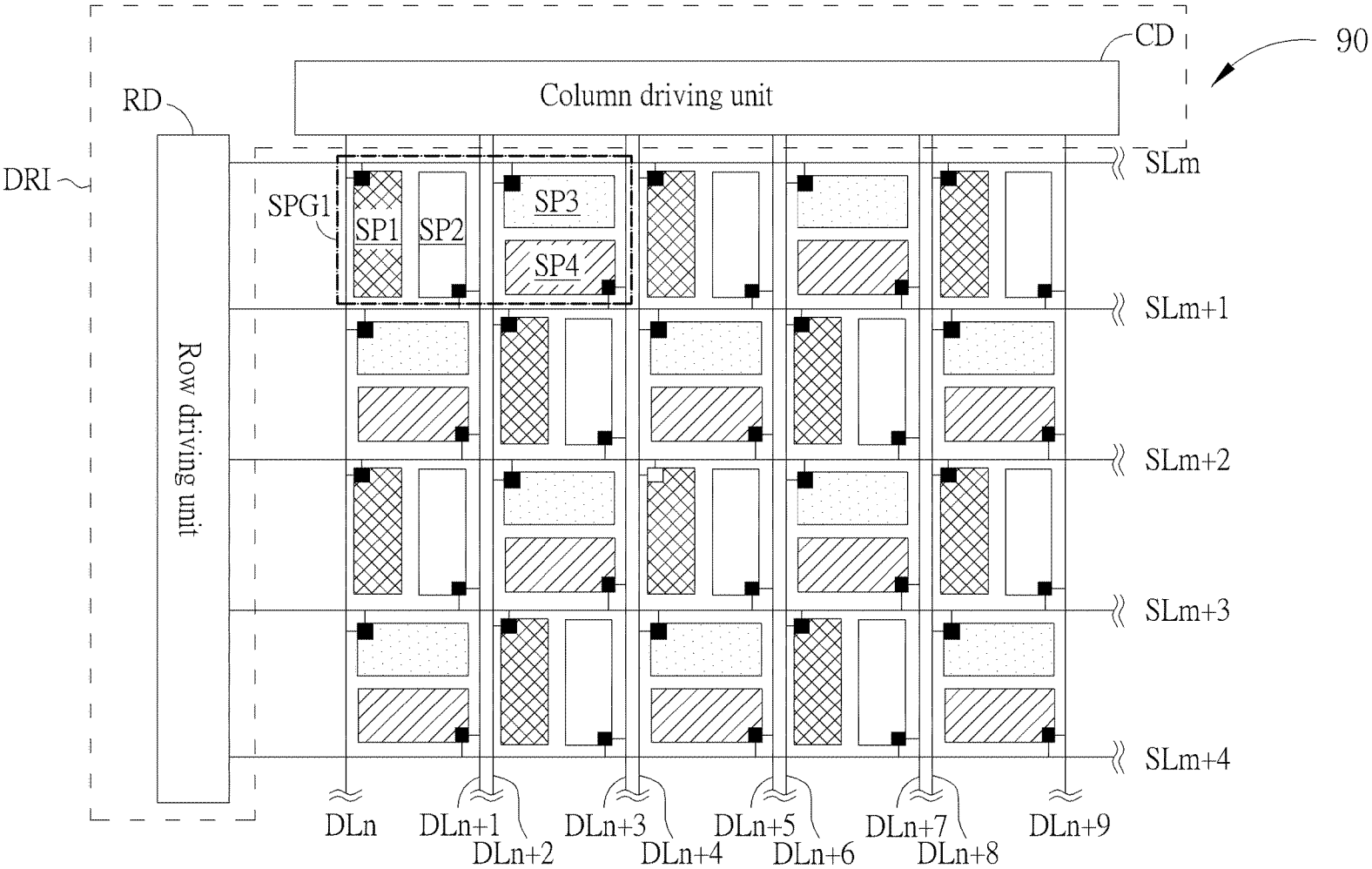
FIG. 13 is a schematic diagram of circuit layout of the display device shown in FIG. 9.

The driving module (e.g. a driving integrated chip (IC)) of the display device may need to be appropriately altered according to the sub-pixel arrangement of the above embodiments. Please jointly refer to FIG. 3 and FIG. 13, wherein FIG. 13 is a schematic diagram of a circuit layout of the display device 90 shown in FIG. 9. As shown in FIG. 13, the display device 90 comprises a driving module DRI and a plurality of sub-pixel groups SPG1. The driving module DRI comprises a column driving unit CD and a row driving unit RD, which are utilized for driving data lines DL1-DLx and scan lines SLm-SLy, respectively. Note that, FIG. 13 only shows the data line DLn-DLn+9, the scan lines SLm-SLm+4 and parts of the plurality of sub-pixel groups SPG1 for illustrations. In the sub-pixel group SPG1 at the upper left corner, the sub-pixel SP1 is coupled to the data line DLn and the scan line SLm; the sub-pixel SP2 is coupled to the data line DLn+1 and the scan line SLm+1; the sub-pixel SP3 is coupled to the data line DLn+2 and the scan line SLm; and the sub-pixel SP4 is coupled to the data line DLn+3 and the scan line SLm+1. The relationships between the data lines DLn-DLn+9, the scan lines SLm-SLm+4 and the rest of the sub-pixel groups SPG1 in FIG. 13 can be acquired by analogy. In brief, the sub-pixels SP1 and SP3 are coupled to the same scan line (e.g. the scan line SLm) and the sub-pixels SP2 and SP4 are coupled to another adjacent scan line (e.g. the scan line SLm+1). In addition, the sub-pixels SP1-SP4 of the sub-pixel group SPG1 are respectively coupled to the nearest data lines. As a result, the circuit layout of the display device 90 realized by repeatedly arranging the sub-pixel group SPG1 can be optimized.

Figure 14:
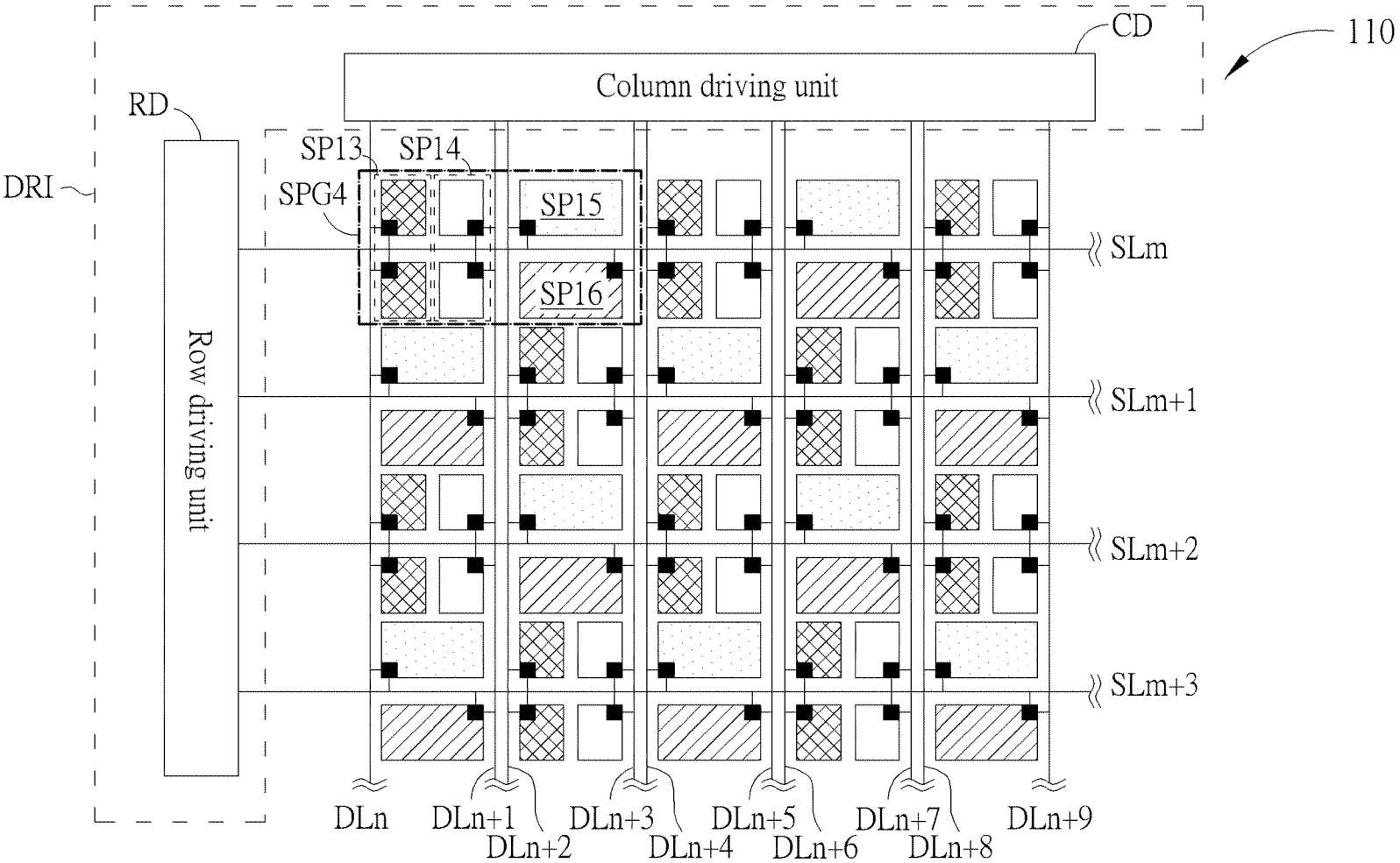
FIG. 14 is a schematic diagram of circuit layout of the display device shown in FIG. 11.

Please jointly refer to FIG. 12 and FIG. 14, wherein FIG. 14 is a schematic diagram of a circuit layout of the display device 110 shown in FIG. 11. As shown in FIG. 14, the display device 110 comprises a driving module DRI and a plurality of sub-pixel groups SPG4. The driving module DRI comprises a column driving unit CD and a row driving unit RD, which are utilized for driving data lines DL1-DLx and scan lines SLm-SLy, respectively. Note that, FIG. 14 only shows the data line DLn-DLn+9, scan lines SLm-SLm+4 and parts of the plurality of sub-pixel groups SPG4 for illustrations. In the sub-pixel group SPG4 at the upper left corner, the secondary sub-pixels SP13A and SP13B are coupled to the data line DLn and the scan line SLm; the secondary sub-pixels SP14A and SP14B are coupled to the data line DLn+1 and the scan line SLm; the sub-pixel SP15 is coupled to the data line DLn+2 and the scan line SLm; and the sub-pixel SP16 is coupled to the data line DLn+3 and the scan line SLm. The relationships between the data lines DLn-DLn+9, the scan lines SLm-SLm+4 and the rest of the sub-pixel groups SPG4 in FIG. 14 can be acquired by analogy. In comparison with the display device 90 shown in FIG. 13, the sub-pixels SP13-SP16 are coupled to the same scan line (e.g. the scan line SLm). As a result, the circuit layout of the display device 110 realized by repeatedly arranging the sub-pixel group SPG4 can be optimized.

Figure 15:
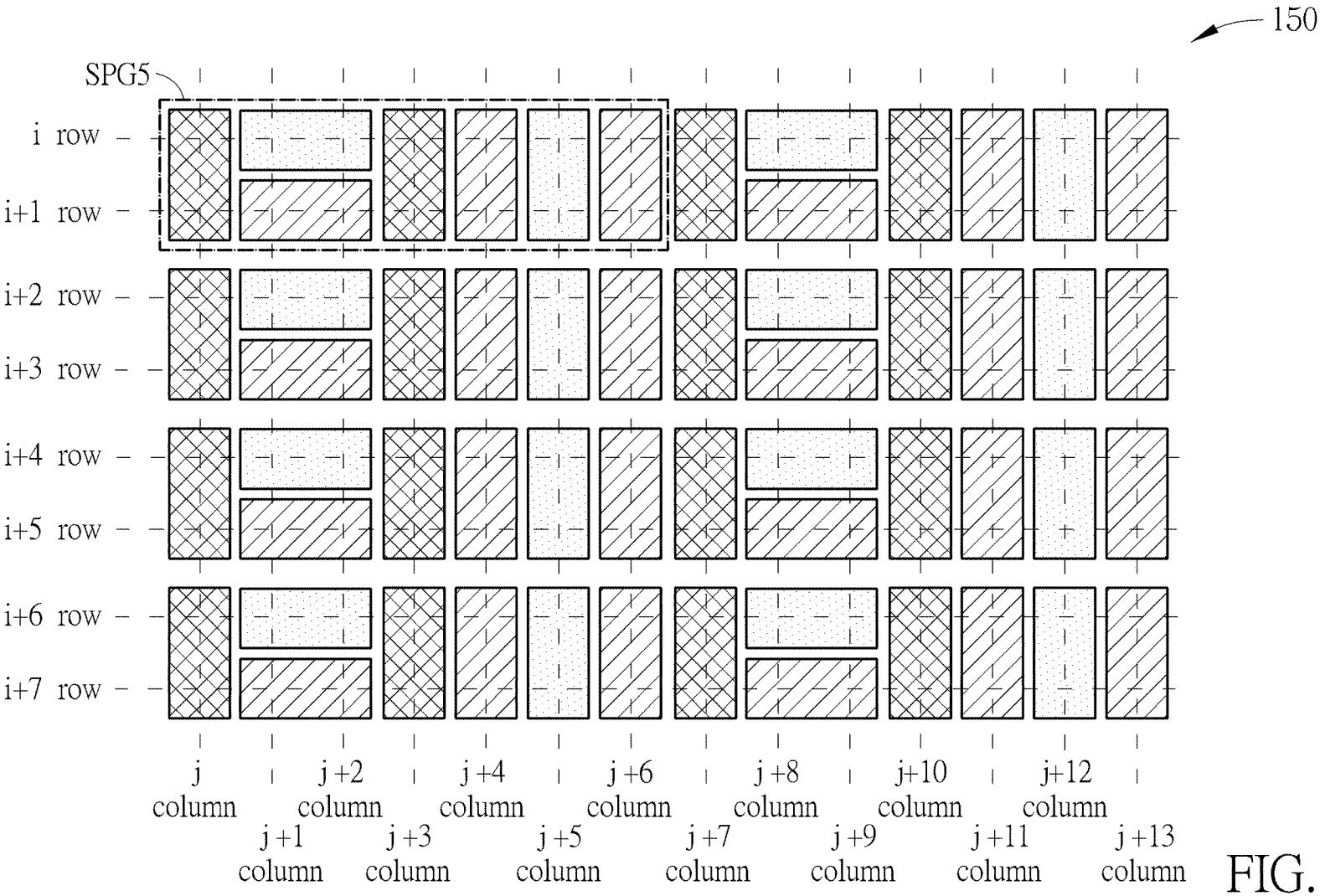
FIG. 15 is a schematic diagram of a display device according to an embodiment of the present invention.
Figure 16:
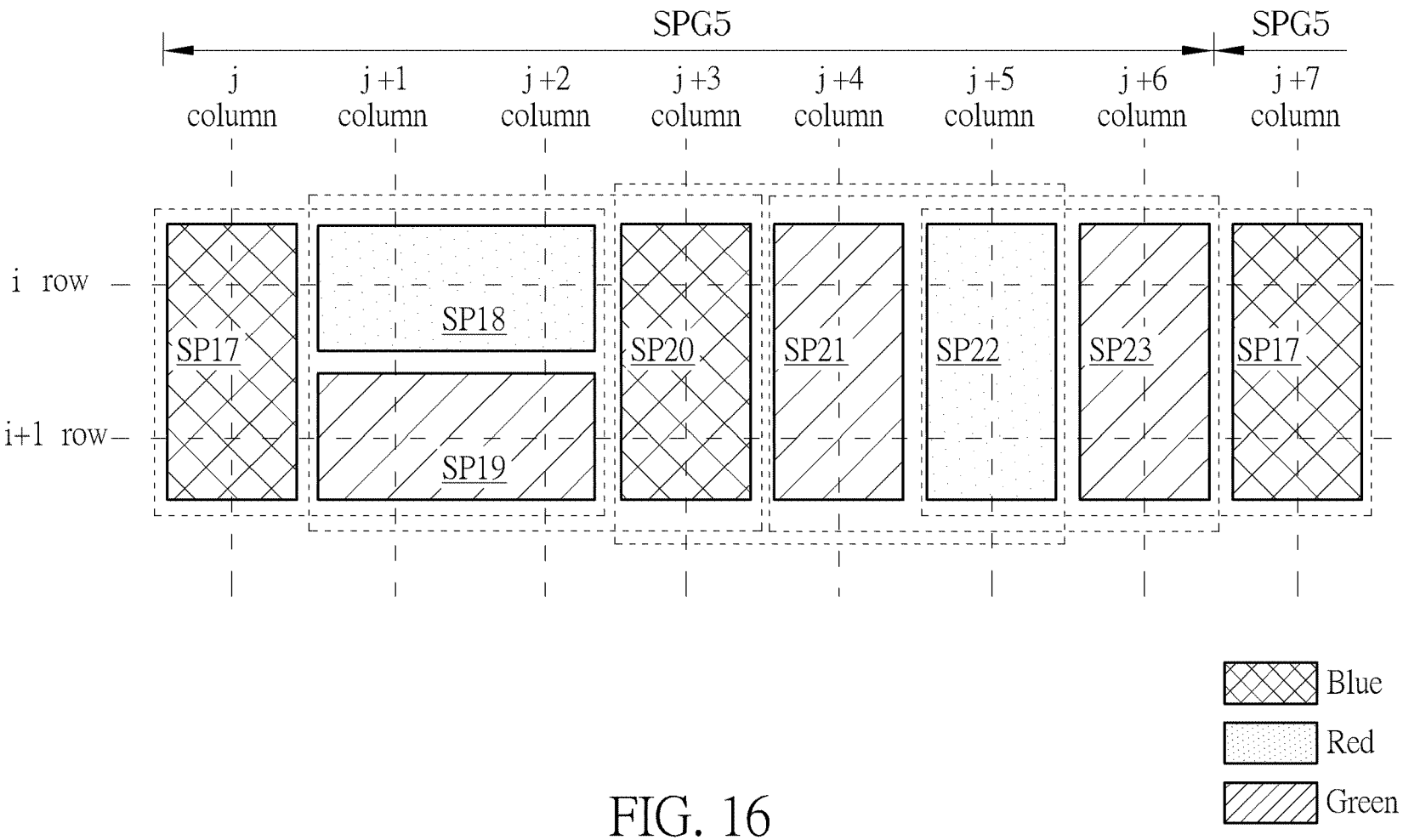
FIG. 16 is a schematic diagram of the sub-pixel group shown in FIG. 15.

Please refer to FIG. 15, which is a schematic diagram of a display device 150 according to an embodiment of the present invention. The display device 150 may be an electronic device with a liquid crystal panel, such as a television, a smart phone or a tablet. FIG. 15 only shows parts of sub-pixels of the display device 150 for illustrations. Note that, FIG. 15 is utilized for illustrating the relative positions of the sub-pixels and not for limiting the ratio between length and width. As shown in FIG. 15, the display device 150 comprises a plurality of repeating sub-pixel groups SPG5 (only one sub-pixel group SPG5 is marked in FIG. 15 for illustrations). In order to simplify the descriptions, please refer to FIG. 16 which is a schematic diagram of the sub-pixel group SPG5 shown in FIG. 15. In FIG. 16, the sub-pixel group SPG5 comprises sub-pixels SP17-SP23. The sub-pixel SP17 is located at the j column, the i row and the i+1 row; the sub-pixel SP18 is transversely located at the j+1 column, the j+2 column and the i row; the sub-pixel SP19 is transversely located at the j+1 column, the j+2 column and the i+1 row; the sub-pixel SP20 is located at the j+3 column, the i row and the i+1 row; the sub-pixel SP21 is located at the j+4 column, the i row and the i+1 row; the sub-pixel SP22 is located at the j+5 column, the i row and the i+1 row; and the sub-pixel SP23 is located at the j+6 column, the i row and the i+1 row. In addition, the adjacent sub-pixels in the sub-pixel group SPG5 are corresponding to different colors. In this embodiment, the sub-pixels SP17-SP23 are corresponding to blue, red, green, blue, green, red and green, respectively. In such a condition, the sub-pixels SP17-SP19 and SP18-20 respectively generate virtual pixels (i.e. 4 sub-pixels are corresponding to 2 pixels) and sub-pixels SP20-22, SP21-SP23, and SP22-23 and SP17 of the sub-pixel group SPG5 located at the adjacent columns generate real pixels (i.e. 3 sub-pixels corresponding to 1 pixel). Via the arrangement shown in FIG. 16, the sub-pixel group SPG5 generates 4 pixels via 7 sub-pixels. Under the condition that the resolution of the display device 150 is constant, the number of the sub-pixels utilized for realizing the display device 150 is reduced and the aperture ratio of the display device 150 is accordingly increased.

Figure 17:
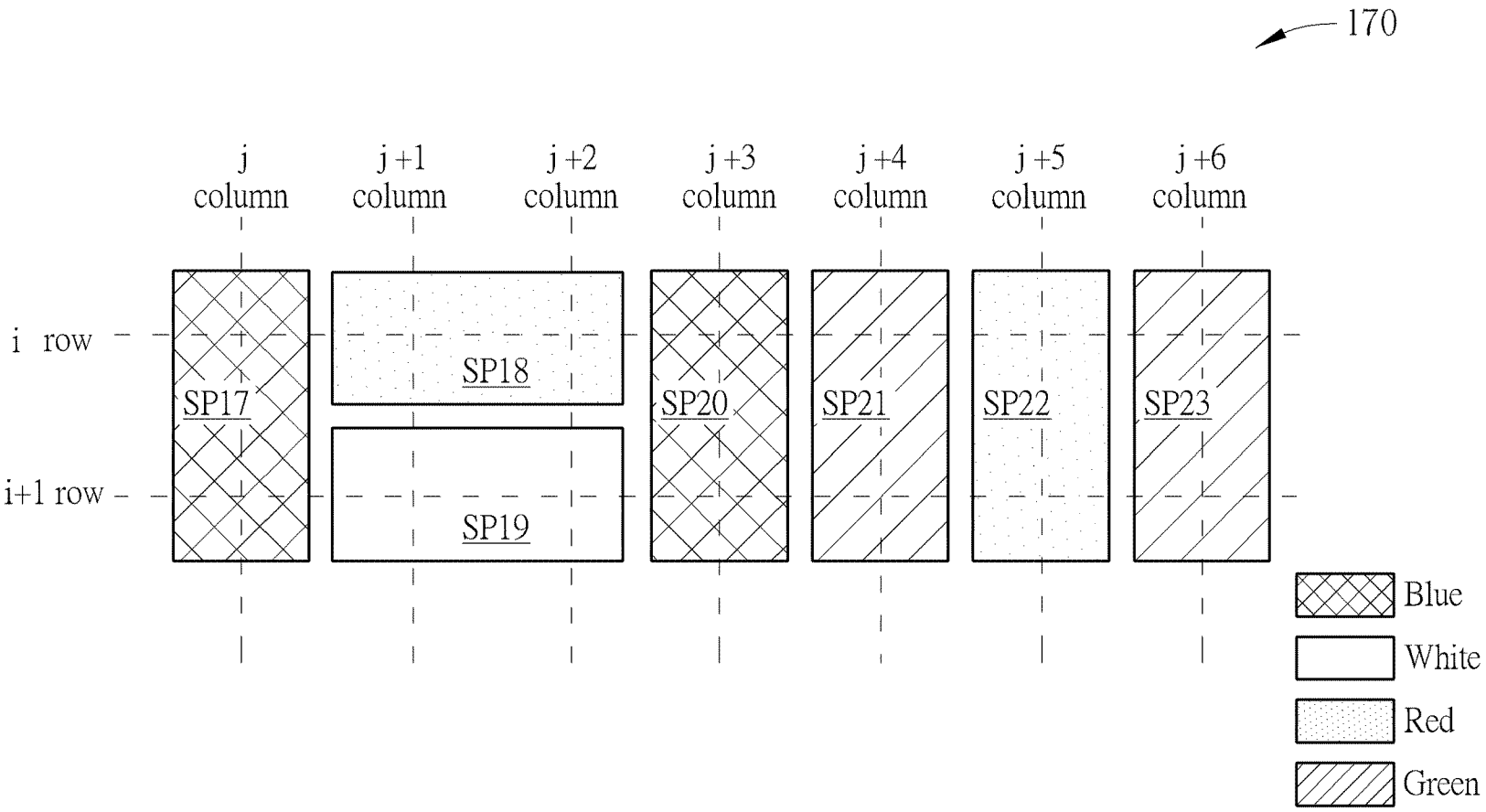
FIG. 17 is a schematic diagram of another color arrangement method of the sub-pixel group shown in FIG. 16.

According to different applications and design concepts, the colors of the sub-pixels SP17-SP23 in the sub-pixel group SPG5 can be appropriately altered. Please refer to FIG. 17, which is a schematic diagram of another color configuration of the sub-pixel group SPG 5 shown in FIG. 16. Different from FIG. 16, the sub-pixel 19 of the sub-pixel group SPG5 shown in FIG. 17 is changed to be corresponding to white. In another embodiment, the sub-pixel SP19 is corresponding to yellow. That is, the sub-pixels SP17-SP23 are corresponding to at least three colors and the adjacent sub-pixels in the sub-pixel group SPG5 are corresponding to different colors.

Figure 18:
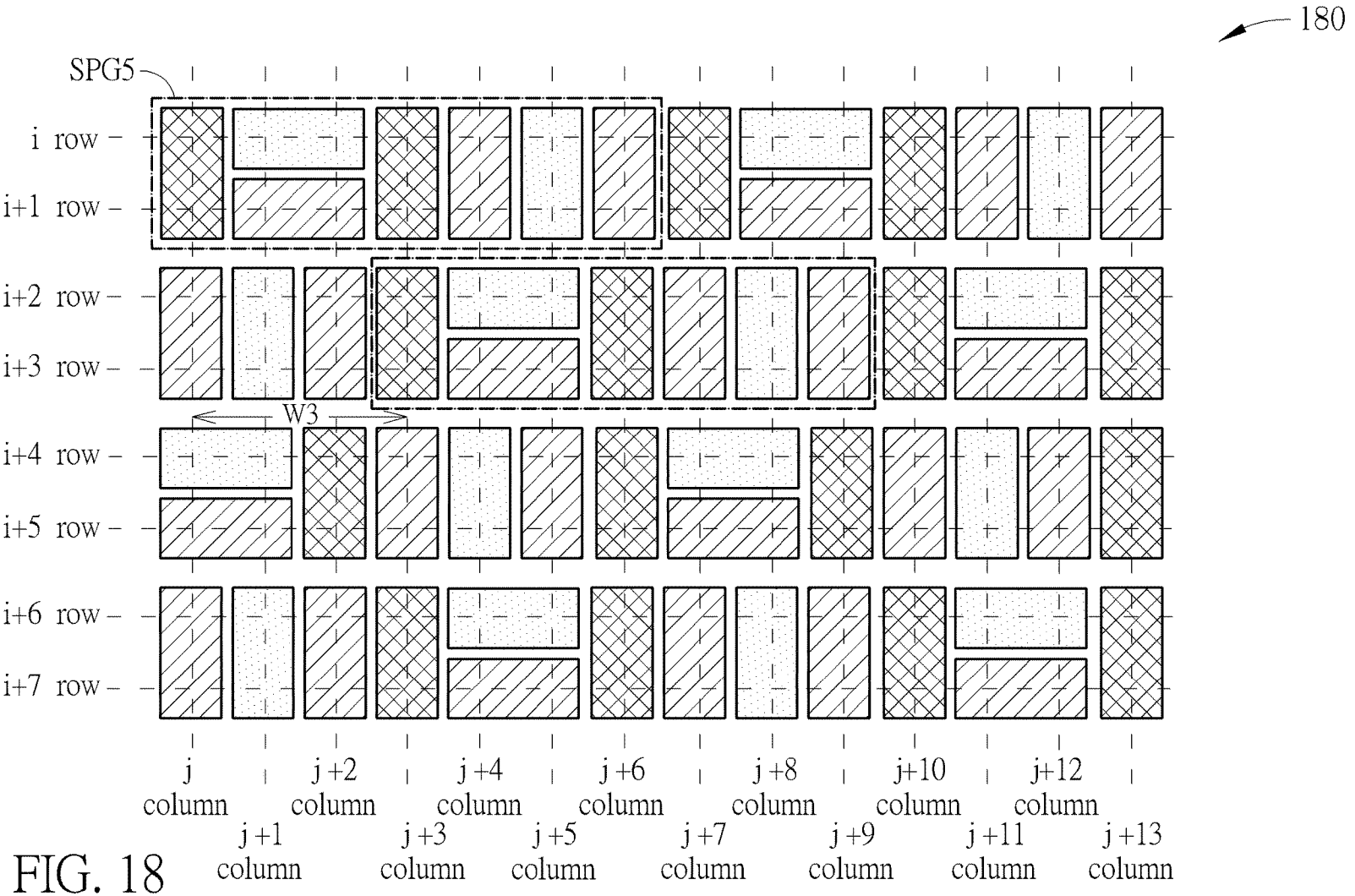
FIG. 18 is a schematic diagram of a display device according to an embodiment of the present invention.

In an embodiment, a horizontal displacement may exist between the sub-pixel groups SPG5 located at the adjacent rows in the display device 150 shown in FIG. 15. Please refer to FIG. 18, which is a schematic diagram of a display device 180 according to an embodiment of the present invention. The display device 180 is similar to the display device 150 shown in FIG. 15, thus the components and the signals with the same functions use the same symbols. Different from the display device 150, a horizontal displacement W3 exists between the sub-pixel groups SPG5 located at the adjacent rows (e.g. the sub-pixel groups SPG5 located at the i row and the i+1 row and those located at the i+2 row and the i+3 row). In this embodiment, the horizontal displacement W3 is three-seventh of the width of the sub-pixel group SPG5. Note that, a sub-pixel group SPGC2 shown in FIG. 18 can be regarded as the repeating sub-pixel group of the display device 180. As a result, the display device 180 equips different sub-pixel arrangement can be realized by the sub-pixel group SPG5 (or the sub-pixel group SPGC2).

Figure 19:
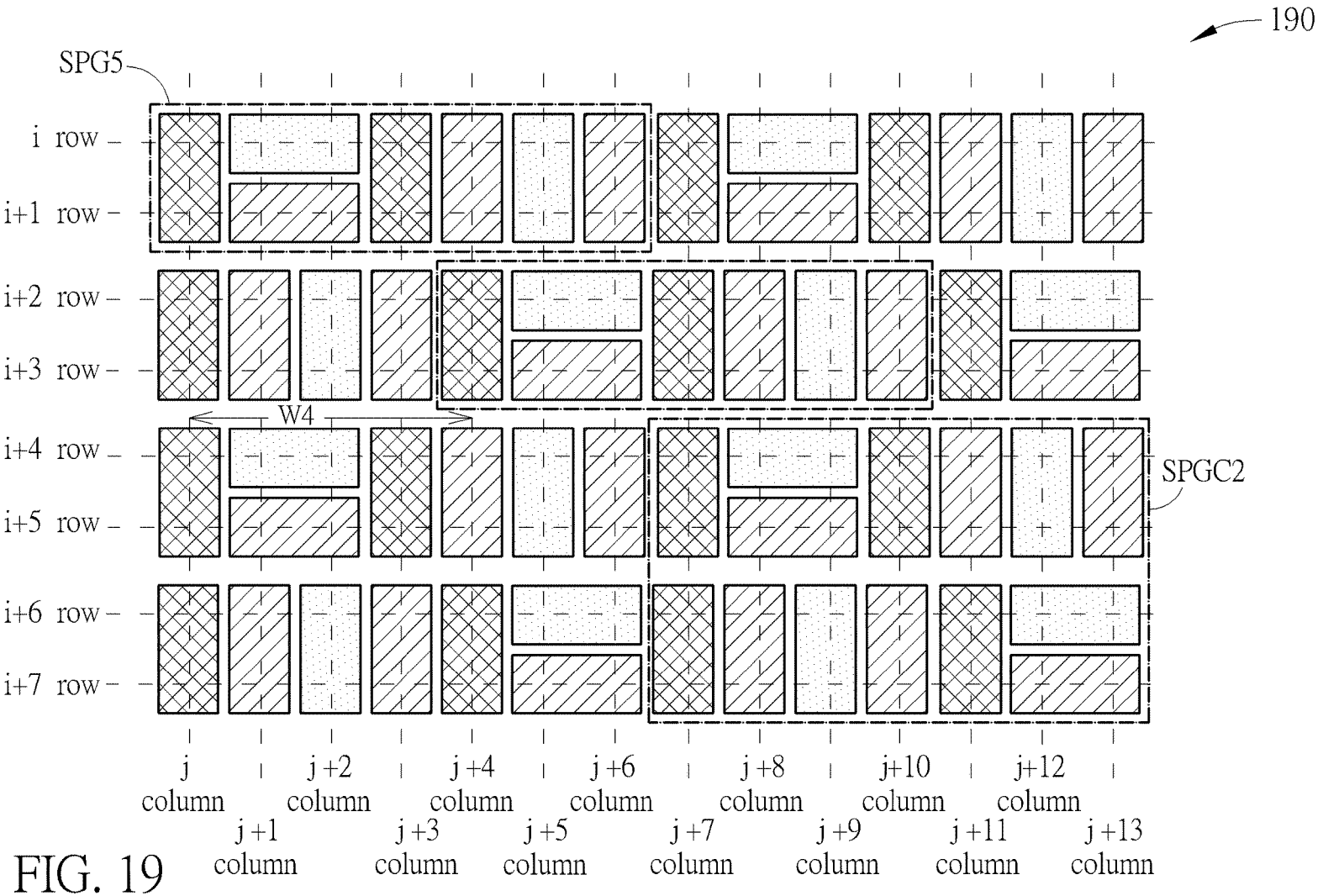
FIG. 19 is a schematic diagram of a display device according to an embodiment of the present invention.

Please refer to FIG. 19, which is a schematic diagram of a display device 190 according to an embodiment of the present invention. The display device 190 is similar to the display device 150 shown in FIG. 15, thus the components and the signals with the same functions use the same symbols. Different from the display device 150, a horizontal displacement W4 exists between the sub-pixel groups SPG5 located at the adjacent rows (e.g. the sub-pixel groups SPG5 located at the i row and the i+1 row and those located at the i+2 row and the i+3 row). In this embodiment, the horizontal displacement W4 is four-seventh of the width of the sub-pixel group SPG5. Note that, a sub-pixel group SPGC3 shown in FIG. 19 can be regarded as the repeating sub-pixel group of the display device 190. As a result, the display device 190 equips different sub-pixel arrangement can be realized by the sub-pixel group SPG5 (or the sub-pixel group SPGC3).

Please note that, the sub-pixels generating the virtual pixels are surrounded by the sub-pixels generating the real pixels in FIG. 19.

Figure 20:
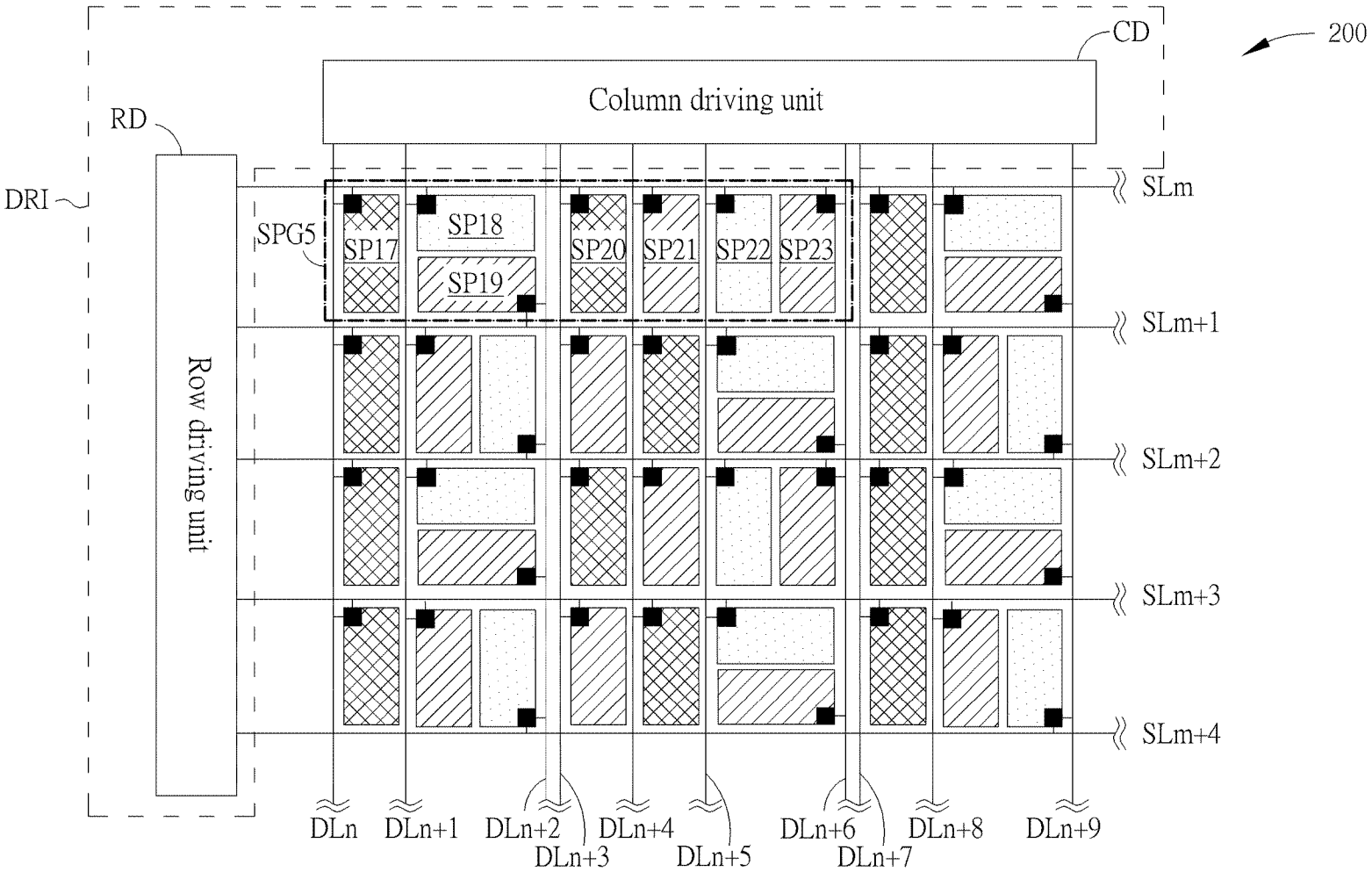
FIG. 20 is a schematic diagram of circuit layout of the display device shown in FIG. 19.

Please refer to FIG. 20, which is a schematic diagram of a circuit layout of the display device 190 shown in FIG. 19.

The display device 190 is similar to the display device 90 shown in FIG. 13, thus the components with the similar functions use the same symbols. As shown in FIG. 20, the display device 190 comprises a driving module DRI and a plurality of sub-pixel groups SPG5. The driving module DRI comprises a column driving unit CD and a row driving unit RD, which are utilized for driving data lines DL1-DLx and scan lines SLm-SLy, respectively. Note that, FIG. 20 only shows the data line DLn-DLn+9, scan lines SLm-SLm+4 and parts of the plurality of sub-pixel groups SPG5 for illustrations. In the sub-pixel group SPG5 at the upper left corner, the sub-pixel SP17 is coupled to the data line DLn and the scan line SLm; the sub-pixel SP18 is coupled to the data line DLn+1 and the scan line SLm; the sub-pixel SP19 is coupled to the data line DLn+2 and the scan line SLm+1; the sub-pixel SP20 is coupled to the data line DLn+3 and the scan line SLm; the sub-pixel SP21 is coupled to the data line DLn+4 and the scan line SLm; the sub-pixel SP22 is coupled to the data line DLn+5 and the scan line SLm; and the sub-pixel SP23 is coupled to the data line DLn+6 and the scan line SLm. The relationships between the data lines DLn-DLn+9, the scan lines SLm-SLm+4 and the rest of the sub-pixel groups SPG5 in FIG. 20 can be acquired by analogy. In the sub-pixel group SPG5, the sub-pixels SP17, SP18, SP21-SP23 are coupled to the same scan line and the sub-pixel SP19 is coupled to another adjacent scan line. As a result, the circuit layout of the display device 190 realized by repeatedly arranging the sub-pixel group SPG5 can be optimized.

Figure 21:
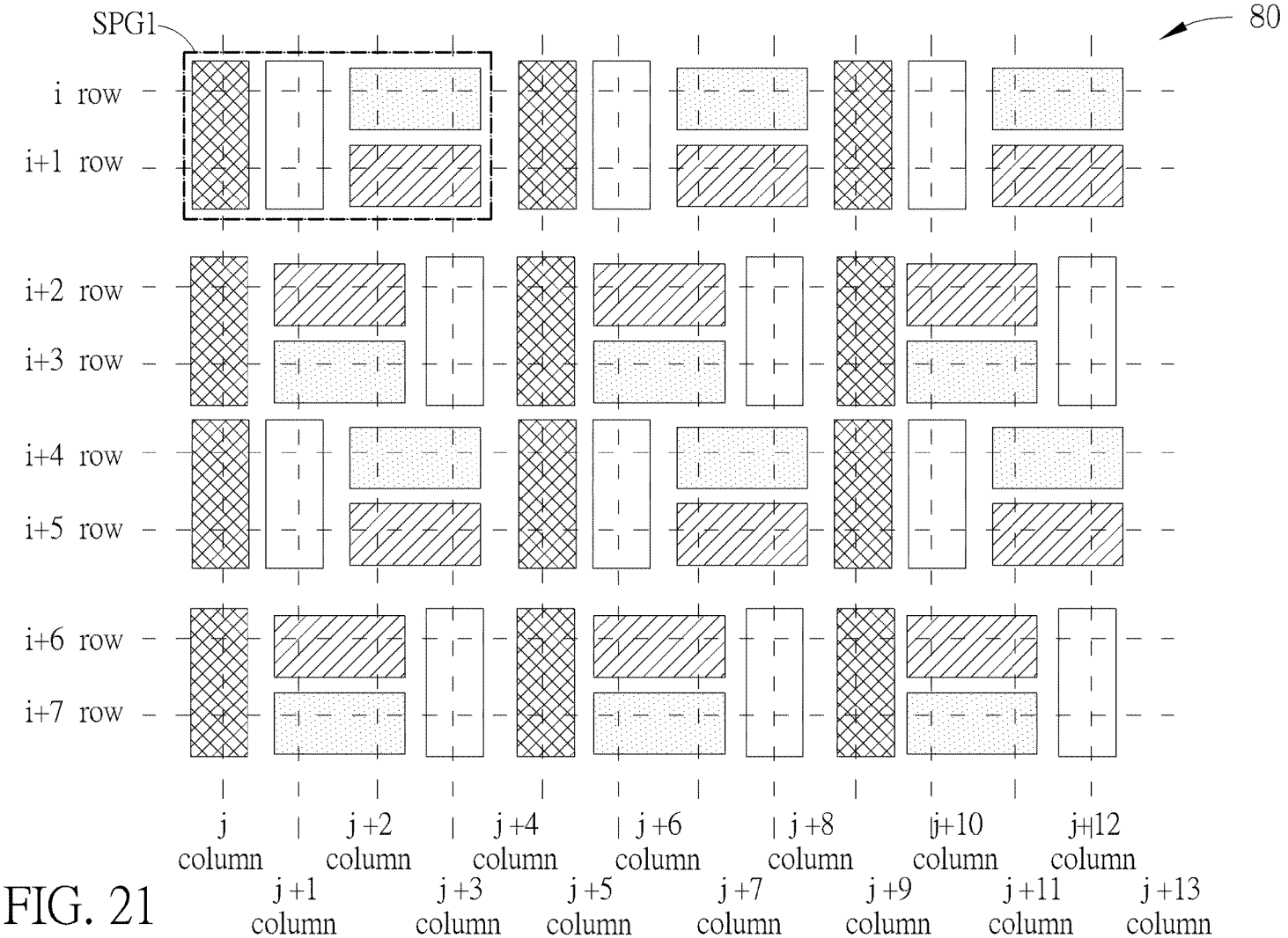
FIG. 21 is a schematic diagram of another implementation of the display device shown in FIG. 8.

According to different applications and design concepts, those with ordinary skill in the art may observe appropriate alternations and modifications. For example, the sub-pixel groups located at the adjacent rows in the display device may have different color arrangements. Please refer to FIG. 3 and FIG. 21, wherein FIG. 21 is a schematic diagram of another implementation of the display device 80 shown in FIG. 8. Different from FIG. 8, the sub-pixel groups SPG1 located at the adjacent rows equip different color arrangements in FIG. 21. As shown in FIG. 21, the sub-pixels SP1-SP4 in the sub-pixel groups SPG1 located at the i row and the i+1 row are corresponding to blue, white, red and green; and the sub-pixels SP1-SP4 in the sub-pixel groups SPG1 located at the i+2 row and the i+3 row are corresponding to white, blue, red and green.

Figure 22A:
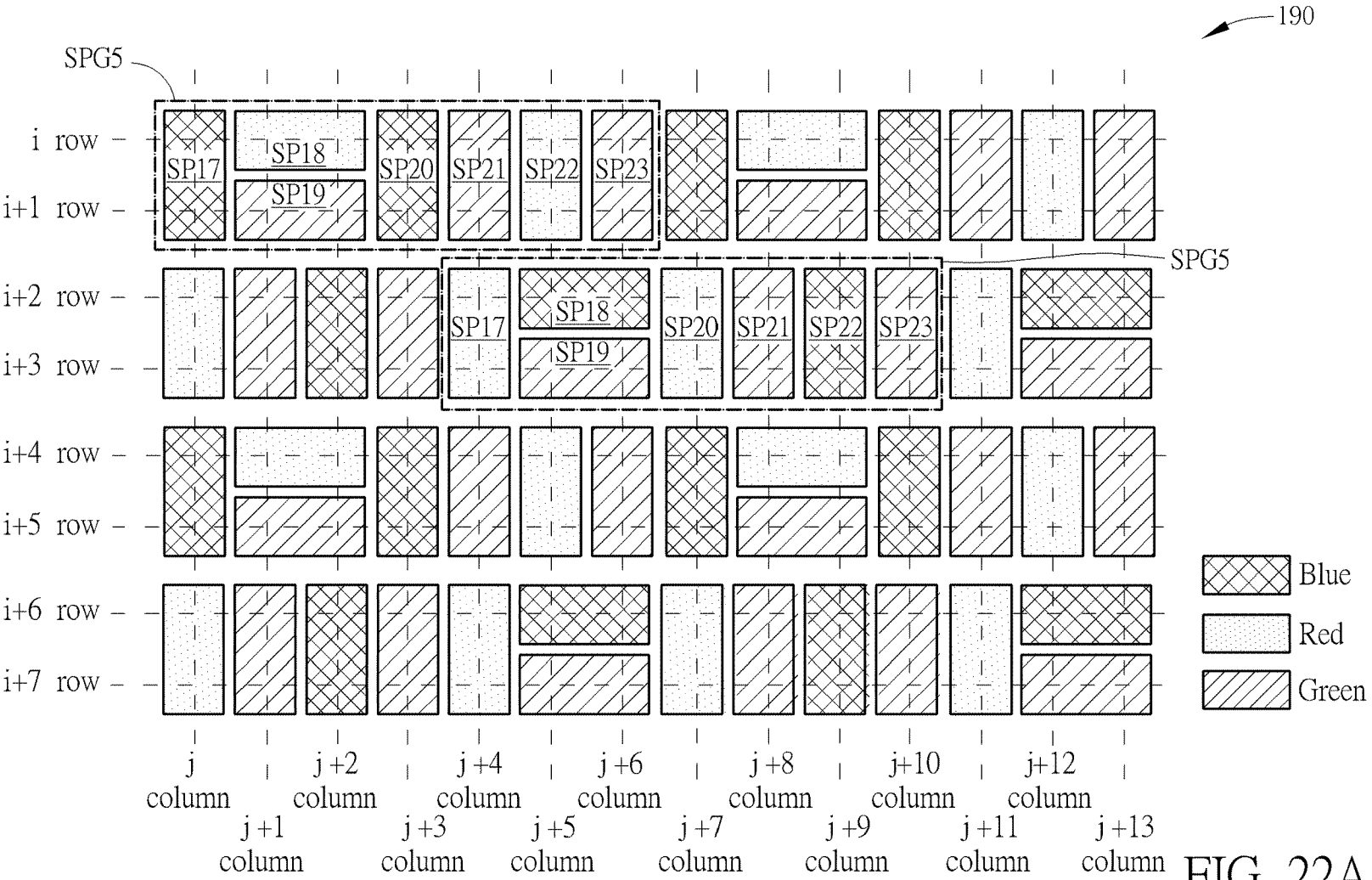
FIGS. 22A-22C are schematic diagrams of other implementations of the display device shown in FIG. 19.
Figure 22B:
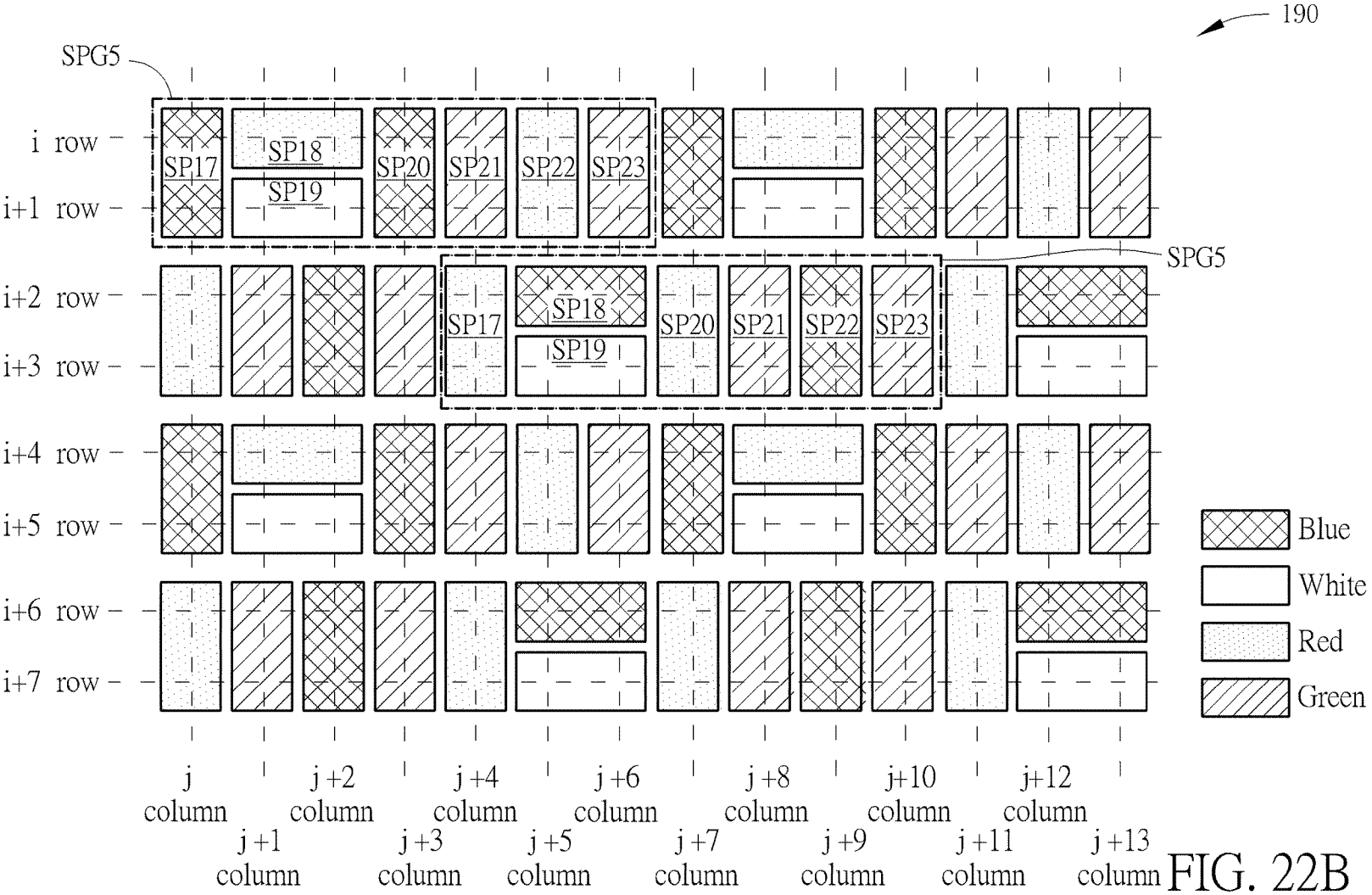
Figure 22C:
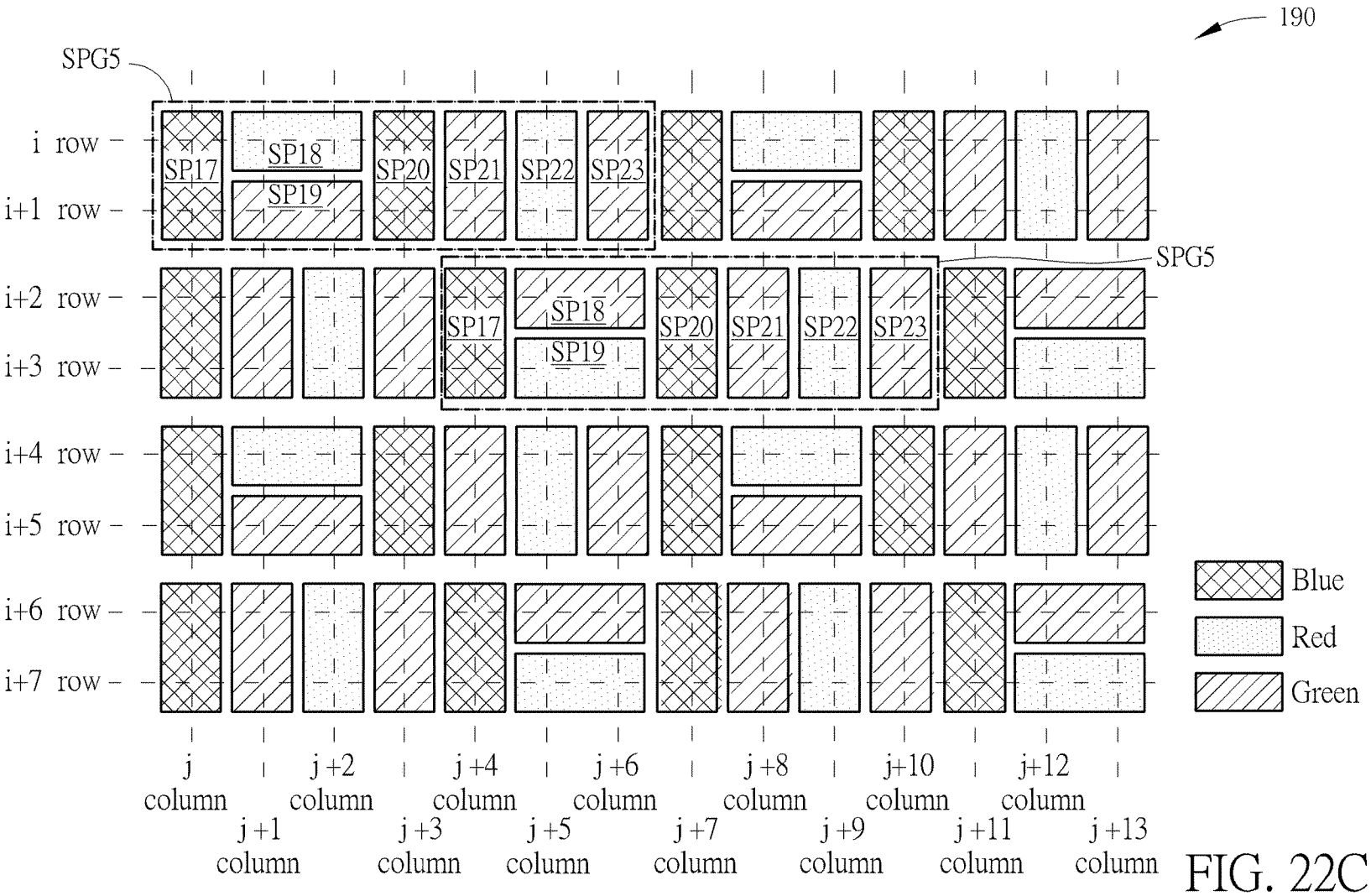

Please refer to FIG. 16 and FIGS. 22A-22C, wherein FIGS. 22A-22C are schematic diagrams of other implementations of the display device 190 shown in FIG. 19. Different from FIG. 19, the sub-pixel groups SPG5 of different rows in FIGS. 22A-22C have different color arrangements. As shown in FIG. 22A, the sub-pixels SP17-SP23 of the sub-pixel groups SPG5 located at the i row and the i+1 row are corresponding to blue, red, green, blue, greed, red and green; and the sub-pixels SP17-SP23 of the sub-pixel groups SPG5 located at the i+2 row and the i+3 row are corresponding to red, blue, green, red, green, blue, and green. In FIG. 22B, the sub-pixels SP17-SP23 of the sub-pixel groups SPG5 located at the i row and the i+1 row are corresponding to blue, red, white, blue, greed, red and green; and the sub-pixels SP17-SP23 of the sub-pixel groups SPG5 located at the i+2 row and the i+3 row are corresponding to red, blue, white, red, green, blue, and green. In FIG. 22C, the sub-pixels SP17-SP23 of the sub-pixel groups SPG5 located at the i row and the i+1 row are corresponding to blue, red, green, blue, greed, red and green; and the sub-pixels SP17-SP23 of the sub-pixel groups SPG5 located at the i+2 row and the i+3 row are corresponding to blue, green, red, blue, green, red, and green.

To sum up, the above embodiments reduce the number of sub-pixels for realizing the display device via altering the sub-pixel arrangement in the display device, so as to increase the aperture ratio and to decrease the power consumption and the layout area of the display device. Moreover, the brightness of the display device is increased and the power consumption is further decreased via adding the sub-pixels corresponding to white.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A display device, comprising a plurality of sub-pixel groups having the same sub-pixel pattern and serving as repetitive units sequentially arranged along a row direction and a column direction, wherein the plurality of sub-pixel groups comprise a first sub-pixel group having two pixels, at least one second sub-pixel group each having two pixels and located at the same columns as a first column and at least one third sub-pixel group each having two pixels and located at the same rows as the first sub-pixel group, and the first sub-pixel group comprises:

a first sub-pixel, locating at the first column, a first row and a second row adjacent to the first row;

a second sub-pixel, locating at a second column adjacent to the first column, the first row and the second row;

a third sub-pixel locating across a third column adjacent to the second column and a fourth column adjacent to the third column; and a fourth sub-pixel locating across the third column and the fourth column;

wherein the third sub-pixel and the fourth sub-pixel locate at two neighboring rows that comprise at least one of the first row and the second row, wherein the first sub-pixel and the second sub-pixel are corresponding to a first pixel of the two pixels of the first sub-pixel group, and the third sub-pixel and the fourth sub-pixel are corresponding to a second pixel of the two pixels of the first sub-pixel group;

wherein the second sub-pixel group comprises:

a fifth sub-pixel, locating at the first column, a third row adjacent to the second row and a fourth row adjacent to the third row;

a sixth sub-pixel, locating at the second column, the first row and the second row;

a seventh sub-pixel, locating across the third column adjacent to the second column and the fourth column adjacent to the third column; and an eighth sub-pixel locating across the third column and the fourth column;

wherein the seventh sub-pixel and the eighth sub-pixel locate at two neighboring rows that comprise at least one of the first row and the second row;

wherein the fifth sub-pixel and the sixth sub-pixel are corresponding to a first pixel of the two pixels of the first sub-pixel group, and the seventh sub-pixel and the eighth sub-pixel are corresponding to a second pixel of the two pixels of the first sub-pixel group.

2. The display device of claim 1, wherein the two neighboring rows are one of the first row and the second row and the third row that is adjacent to the one of the first row and the second row and the plurality of sub-pixel groups located at the two neighboring rows exists a horizontal displacement.

3. The display device of claim 1, wherein a polarity of the first sub-pixel is opposite to a polarity of the second sub-pixel and a polarity of the third sub-pixel is opposite to a polarity of the fourth sub-pixel.

4. The display device of claim 1, wherein the first sub-pixel comprises:

a first secondary sub-pixel, located at the first column and the first row; and a second secondary sub-pixel, located at the first column and the second row;

wherein the second sub-pixel comprises:

a third secondary sub-pixel, located at the second column and the first row; and a fourth secondary sub-pixel, located at the second column and the second row.

5. The display device of claim 1, wherein the first sub-pixel, the second sub-pixel, the third sub-pixel and the fourth sub-pixel are corresponding to at least three colors.

6. The display device of claim 1, wherein the first sub-pixel, the second sub-pixel, the third sub-pixel and the fourth sub-pixel are corresponding to four colors comprising white.

7. The display device of claim 1, wherein the first sub-pixel, the second sub-pixel, the third sub-pixel and the fourth sub-pixel are corresponding to four colors comprising yellow.

8. The display device of claim 1, wherein the first sub-pixel, the second sub-pixel, the third sub-pixel and the fourth sub-pixel are corresponding to two pixels.

9. The display device of claim 1, wherein the first sub-pixel and the at least one third sub-pixel group have different color arrangements.

10. The display device of claim 1, wherein the two neighboring rows are the first row and the second row.

11. A driving module, for a display device comprising a plurality of sub-pixel groups having the same sub-pixel pattern and serving as repetitive units sequentially arranged along a row direction and a column direction, wherein the plurality of sub-pixel groups comprise a first sub-pixel group having two pixels, at least one second sub-pixel group each having two pixels and located at the same columns as a first column and at least one third sub-pixel group each having two pixels and located at the same rows as the first sub-pixel group, and the first sub-pixel group comprises a first sub-pixel, locating at the first column, a first row and a second row adjacent to the first row; a second sub-pixel, locating at a second column adjacent to the first column and the first row and the second row; a third sub-pixel locating at a third column adjacent to the second column and a fourth column adjacent to the third column; and a fourth sub-pixel locating across the third column and the fourth column; wherein the third sub-pixel and the fourth sub-pixel locate at two neighboring rows that comprise at least one of the first row and the second row, wherein the first sub-pixel and the second sub-pixel are corresponding to a first pixel of the two pixels of the first sub-pixel group, and the third sub-pixel, and the fourth sub-pixel are corresponding to a second pixel of the two pixels of the first sub-pixel group; wherein the second sub-pixel group comprises a fifth sub-pixel, locating at the first column, a third row adjacent to the second row and a fourth row adjacent to the third row; a sixth sub-pixel, locating at the second column, the first row and the second row; a seventh sub-pixel, locating across the third column adjacent to the second column and the fourth column adjacent to the third column; and an eighth sub-pixel locating across the third column and the fourth column; wherein the seventh sub-pixel and the eighth sub-pixel locate at two neighboring rows that comprise at least one of the first row and the second row; wherein the fifth sub-pixel and the sixth sub-pixel are corresponding to a first pixel of the two pixels of the first sub-pixel group, and the seventh sub-pixel and the eighth sub-pixel are corresponding to a second pixel of the two pixels of the first sub-pixel group.

12. The driving module of claim 11, comprising:

a row driving unit, for driving a plurality of scan lines, wherein the first sub-pixel and the third sub-pixel are coupled to a first scan line of the plurality scan lines and the second sub-pixel and the fourth sub-pixel are coupled to a second scan line of the plurality of plurality of scan lines; and a column driving unit, for driving a plurality of data lines, wherein the first sub-pixel is coupled to a first data line of the plurality of data lines, the second sub-pixel is coupled to a second data line adjacent to the first data line, the third sub-pixel is coupled to a third data line adjacent to the second data line, and the fourth sub-pixel is coupled to a fourth data line adjacent to the third data line.

13. The driving module of claim 12, wherein the first scan line is adjacent to the second scan line.

14. The driving module of claim 12, wherein the first sub-pixel comprises:

a first secondary sub-pixel, located at the first column and the first row; and a second secondary sub-pixel, located at the first column and the second row;

wherein the second sub-pixel comprises:

a third secondary sub-pixel, located at the second column and the first row; and a fourth secondary sub-pixel, located at the second column and the second row.

15. The driving module of claim 14, wherein the first scan line and the second scan line are the same.

* * * * *